US007744388B2

(12) United States Patent
Lee

(10) Patent No.: US 7,744,388 B2
(45) Date of Patent: Jun. 29, 2010

(54) ELECTRICAL CONNECTOR HAVING A PROTECTIVE DOOR ELEMENT

(75) Inventor: Scott David Lee, Terrigal (AU)

(73) Assignee: ADC GmbH, Berlin (DE)

( * ) Notice: Subject to any disclaimer, the term of this patent is extended or adjusted under 35 U.S.C. 154(b) by 162 days.

(21) Appl. No.: 11/971,038

(22) Filed: Jan. 8, 2008

(65) Prior Publication Data

US 2009/0017656 A1 Jan. 15, 2009

(30) Foreign Application Priority Data

Jul. 10, 2007 (AU) ..... 2007903724

(51) Int. Cl.
*H01R 13/44* (2006.01)

(52) U.S. Cl. ..... 439/144

(58) Field of Classification Search ..... 439/676, 439/135–144; 385/78, 92, 88
See application file for complete search history.

(56) References Cited

U.S. PATENT DOCUMENTS 5,224,868 A * 7/1993 Tseng ..... 439/136
5,769,647 A * 6/1998 Tulley et al. ..... 439/144
5,964,600 A * 10/1999 Miles et al. ..... 439/140
6,352,375 B1 * 3/2002 Shimoji et al. ..... 385/92
7,338,315 B2 * 3/2008 Fauriot et al. ..... 439/535
7,364,444 B2 * 4/2008 Kellock et al. ..... 439/138
2004/0142589 A1 7/2004 Caveney

FOREIGN PATENT DOCUMENTS

WO WO 2005/025007 A1 3/2005

OTHER PUBLICATIONS

US Design Application No. 29/302,008.
US Design Application No. 29/302,006.

* cited by examiner

*Primary Examiner*—Briggitte R Hammond
(74) *Attorney, Agent, or Firm*—Merchant & Gould P.C.

(57) ABSTRACT

An electrical connector including a housing having a socket shaped to at least partially receive a mating plug; a plurality of electrically conductive contact elements at least partially extending into said socket for effecting electrical connection with corresponding electrically conductive contacts of the plug; and a door element coupled to the housing, wherein the door element is mounted for slidable movement along a non-linear path between an open position whereby the socket is laid open for engagement by the mating plug and a closed position whereby access to the socket is inhibited.

29 Claims, 27 Drawing Sheets

ELECTRICAL CONNECTOR HAVING A PROTECTIVE DOOR ELEMENT

TECHNICAL FIELD OF INVENTION

The present invention relates to an electrical connector having a protective door element.

BACKGROUND OF INVENTION

The electrical socket 102 shown in FIG. 1 is shaped to receive a mating electrical plug 104 to make electrical data or electrical power connections there between. The electrical plug 104 may be connected to a patch cable 106 which may lead to a data device such as a computer or a powered device such as a telephone. The electrical socket includes exposed conductive elements 108 that engage with corresponding conductive elements (not shown) in the electrical plug 104 to create a conductive connection there between. An example electrical socket is an RJ-type connector.

The exposed conductive elements 108 may be contacted by unwanted objects or materials. That is, materials other than an electrical plug 104. For example, the conductive elements 108 may be contacted by a child's finger, or a child pressing a thin conductive device (e.g. a paper clip) into the socket, or by accumulation of contaminant material in the socket, for example dust, water or oil particles. Accumulation of contaminant particles in an electrical connector is possible due to particles or contaminants carried in the air, especially in humid or dirty environments. Dust, oil and condensed water vapour can cause false conduction to occur between the conductors; contaminants can also corrode the conductive elements and block connections being made when an electrical mating plug is inserted.

U.S. Pat. No. 6,869,297; U.S. Pat. No. 5,769,647; U.S. Pat. No. 5,964,600; and PCT/AU2004/001222, each disclose arrangements that include door elements pivotally movable between open and closed positions. In the open position the connector cavity is exposed and socket is adapted to receive a plug. When the connector does not have a mating plug inserted therein, the door element is movable to a closed position for inhibiting access to the contacts.

The above described prior art connector door elements may be too easy to operate, thereby allowing a child to mistakenly contact the conductive elements, or they may require additional space on the face of the connector to accommodate the door element.

It is generally desirable to overcome or ameliorate one or more of the above difficulties, or to at least provide a useful alternative.

SUMMARY OF INVENTION

In accordance with one aspect of the present invention, there is provided an electrical connector including:

(a) a housing having a socket shaped to at least partially receive a mating plug;

(b) a plurality of electrically conductive contact elements at least partially extending into said socket for effecting electrical connection with corresponding electrically conductive contacts of the plug; and (b) a door element coupled to the housing, wherein the door element is mounted for slidable movement along a nonlinear path between an open position whereby the socket is laid open for engagement by the mating plug and a closed position whereby access to the socket is inhibited.

In accordance with one aspect of the present invention, there is provided a door element for an electrical connector, including:

(a) a generally planar exterior surface for inhibiting access to a socket of the electrical connector;

(b) two pairs lugs extending from opposite sides of the door element for at least partially extending into corresponding guides of the electrical connector, wherein the lugs facilitate translation of the door element to lay the socket open to receive a mating connector plug or to inhibit access to the socket by said plug.

BRIEF DESCRIPTION OF THE DRAWINGS

Preferred embodiments of the invention are hereinafter described, by way of non-limiting example only, with reference to the accompanying drawings, in which.

DETAILED DESCRIPTION OF PREFERRED EMBODIMENTS OF THE INVENTION

Figure 1:
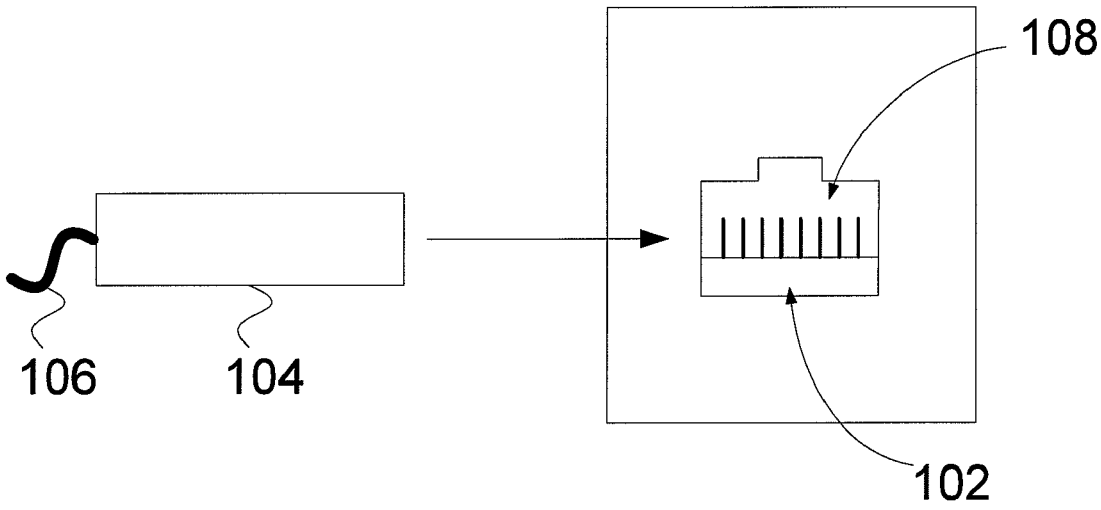
Figure 1 (Prior Art)
FIG. 1 is a diagrammatic illustration of a perspective view of a prior art electrical connector and corresponding plug.
Figure 2:
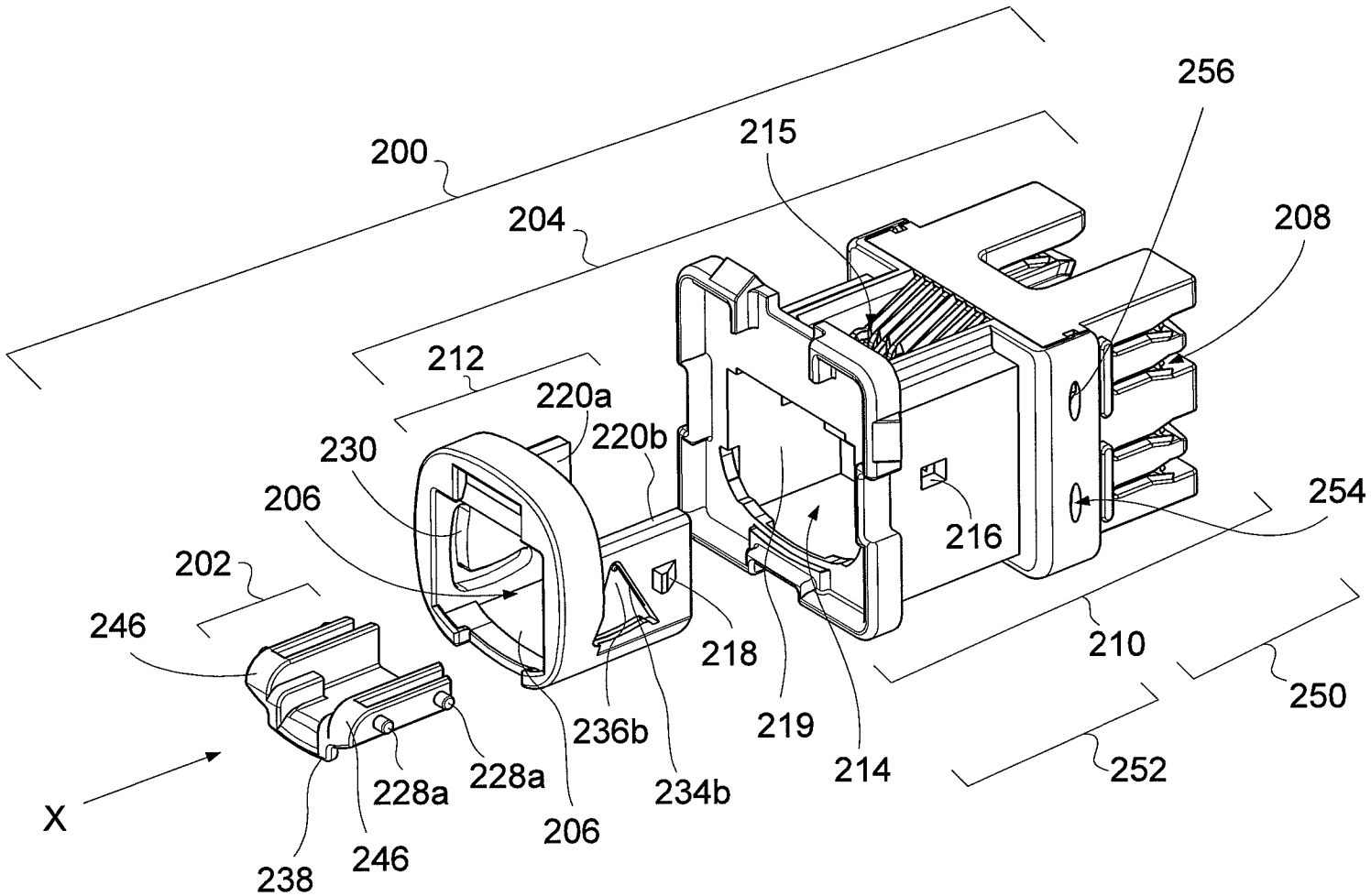
FIG. 2 is diagrammatic illustration of an exploded perspective view of an electrical connector in accordance with a preferred embodiment of the invention.

The electrical connector 200 shown in FIG. 2 is an RJ-type connector, for example, that includes a socket 206 shaped to receive a mating plug (not shown); electrically conductive contact elements 215 arranged in the socket for electrical coupling to corresponding electrically conductive contacts of the plug; and a door element 202 that is arrangeable between open and closed positions. The door 202 inhibits access to the electrically conductive contacts 215 when arranged in the closed position. The door element 202 is mounted for sliding movement on a nonlinear path from the closed to the open position pursuant to engagement by and movement of the mating plug to insert it into the socket.

The connector door element 202 advantageously inhibits access to the electrically conductive elements 215 arranged in the socket 214 by you children. The connector door element 202 advantageously does not need additional space on the face of the connector to accommodate the door.

The electrical connector 200 is described hereafter in further detail. The connector 200 includes the following parts:

1. A pedestal portion 250 with pedestals having insulation displacement contacts (IDCs) 208 seated therein;

2. A central portion 252, slideably coupled to the pedestal portion 250. Lugs 256 of the pedestal portion 250 lock into corresponding recesses 254 of the central portion 252 when the parts slide together;

3. An insert 212 that is slideably seated in the central portion 252 through aperture 214; and 4. A door element 202 that is seated in the insert 212.

The pedestal portion 250 and central portion 252 form a body 210 for the insert 212. The body 210 and insert 212 form a mount 204 for the door element 202.

Figure 5:
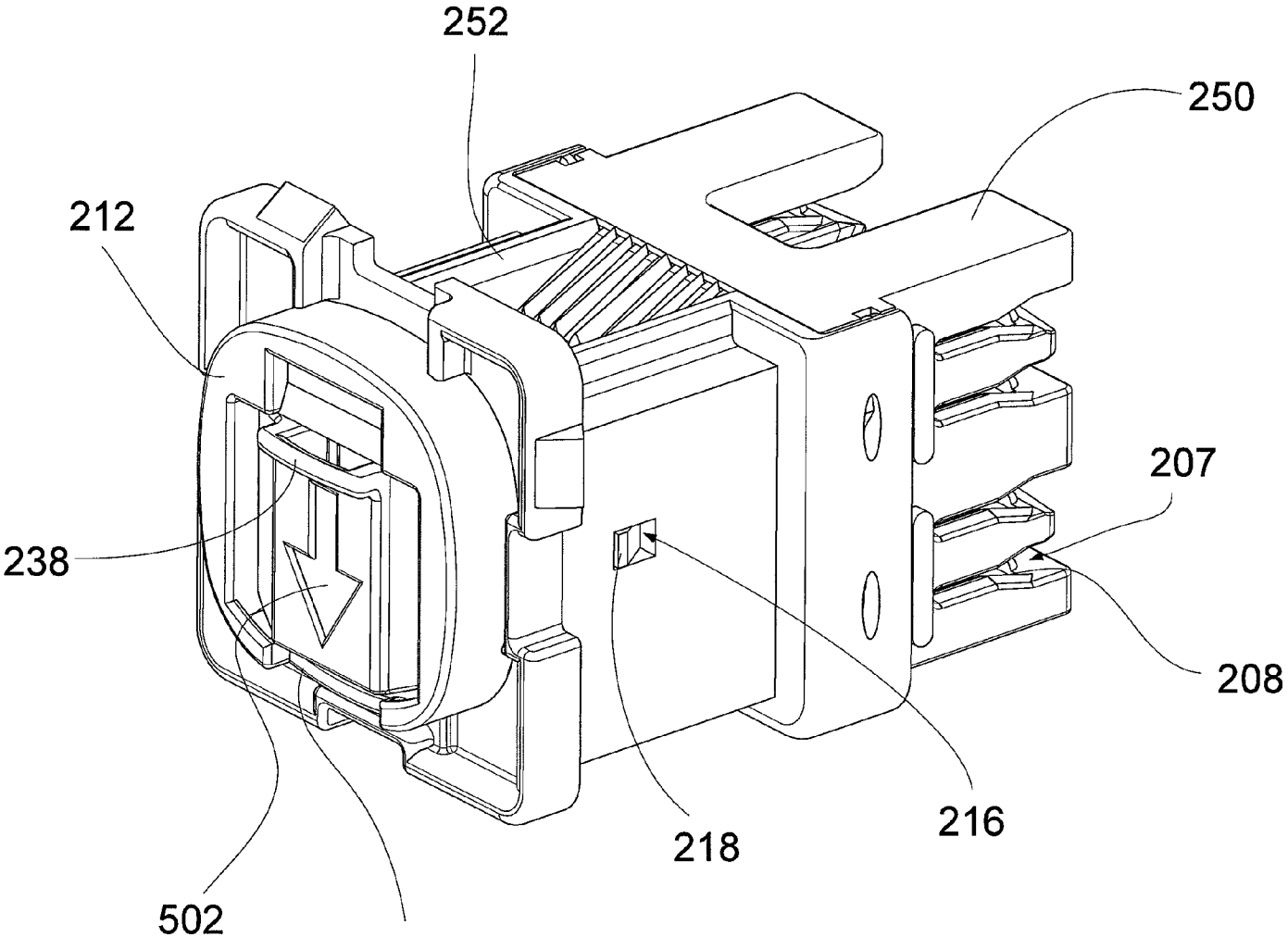
FIG. 5 is a diagrammatic illustration perspective view of the electrical connector show in FIG. 2 showing the door element in a closed condition of use.
Figure 6:
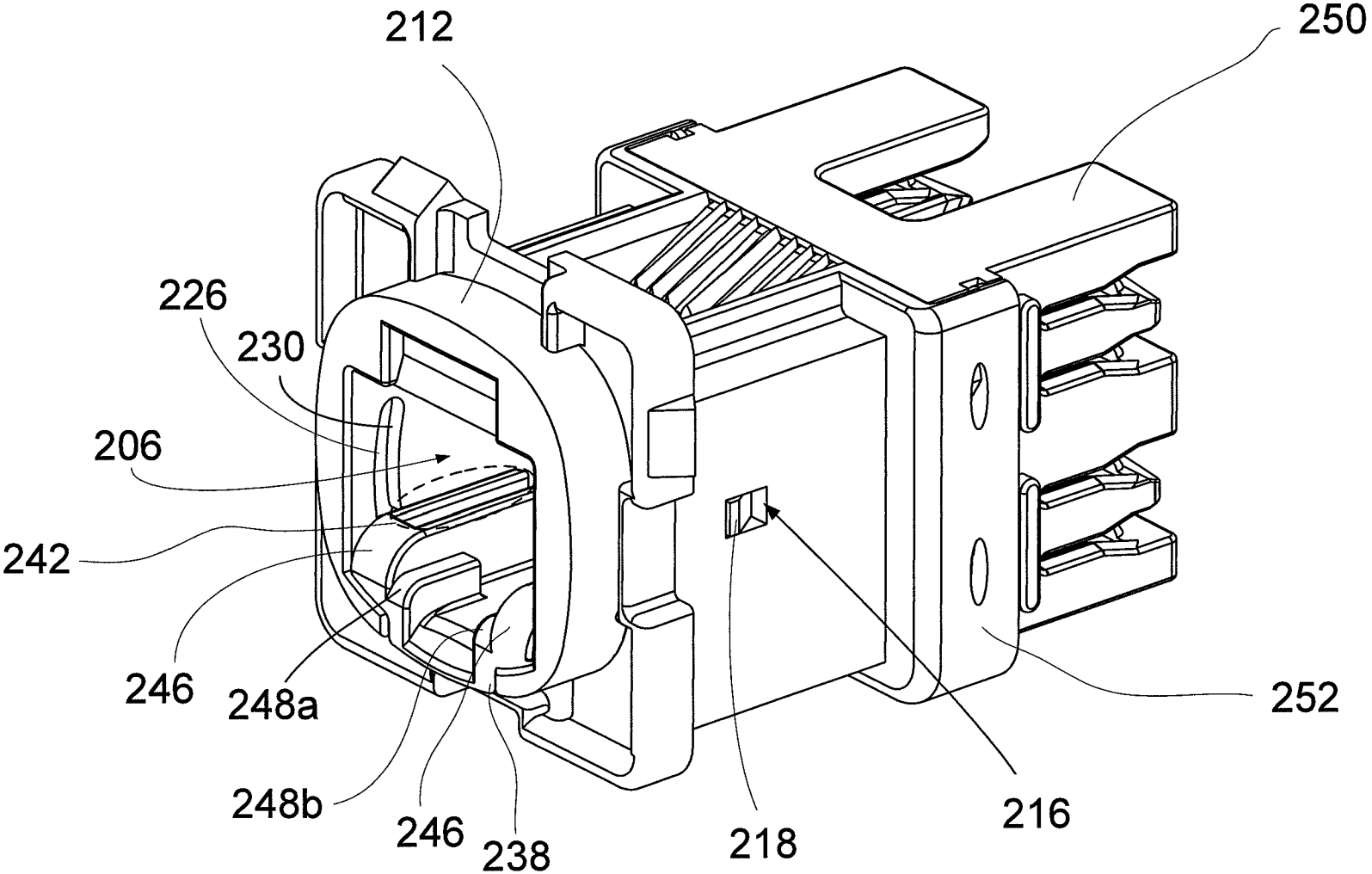
FIG. 6 is a diagrammatic illustration of a perspective view of the electrical connector shown in FIG. 2 showing the door element in an open condition of use.

The door element 202 is movable between a closed position shown in FIG. 5 and an open position shown in FIG. 6. In the open position, the socket 206 is laid open so as to receive an electrical mating plug, e.g. an RJ-type mating plug, which electrically contacts the contact elements 215. In the closed position, the socket is substantially covered.

The mount 204 includes a plurality of electrically conductive contact elements 215 for electrically connecting a plurality of electrically conductive wires of a first data cable 105 to a plurality of corresponding electrically conductive wires of a second data cable (not shown). First ends of the contacts 215 are arranged in the socket 206 for electrical engagement to a mating plug 104 of the first data cable 105. The first ends of the contacts 215 are electrically connected to respective ones of the conductors of the first data cable when the plug 104 of the data cable is inserted into the aperture 206 in the manner shown in FIGS. 3 and 4. Second ends of the contacts 215 are insulation displacement contacts 208 seated in corresponding insulation displacement contact slots 207 of the pedestal portion 250 of the connector 200.

As particularly shown in FIG. 2, the body 210 of the mount 204 includes a body aperture 214 shaped to receive the insert 212. The body 210 further includes one or more recesses 216 shaped to receive corresponding lugs 218 coupled to the insert 212. The lugs 218 engage corresponding recesses 216 and thereby hold the insert substantially in place inside the body 210.

The insert 212 includes locking arms 220*a*, 220*b* for securing the insert 212 in the body 210. When the insert 212 is slideably inserted into the body 210, cam surfaces 222 on the one or more lugs 218 bear against the interior walls 219 of body 210 to resiliently deflect the arms 220 away from the interior walls 219 of body 210. The insert 212 slides into the body 210 until the lugs 218 align with recesses 216. When so located, the lugs 218 are pressed into the recesses 216 by a force generated through the natural resilience of arms 220. When inserted in recesses 216, the locking surface 224 of each lug 218 engages with the locking surface (not shown) of the corresponding recess 216, thus holding the insert substantially in place in the body.

Figure 7:
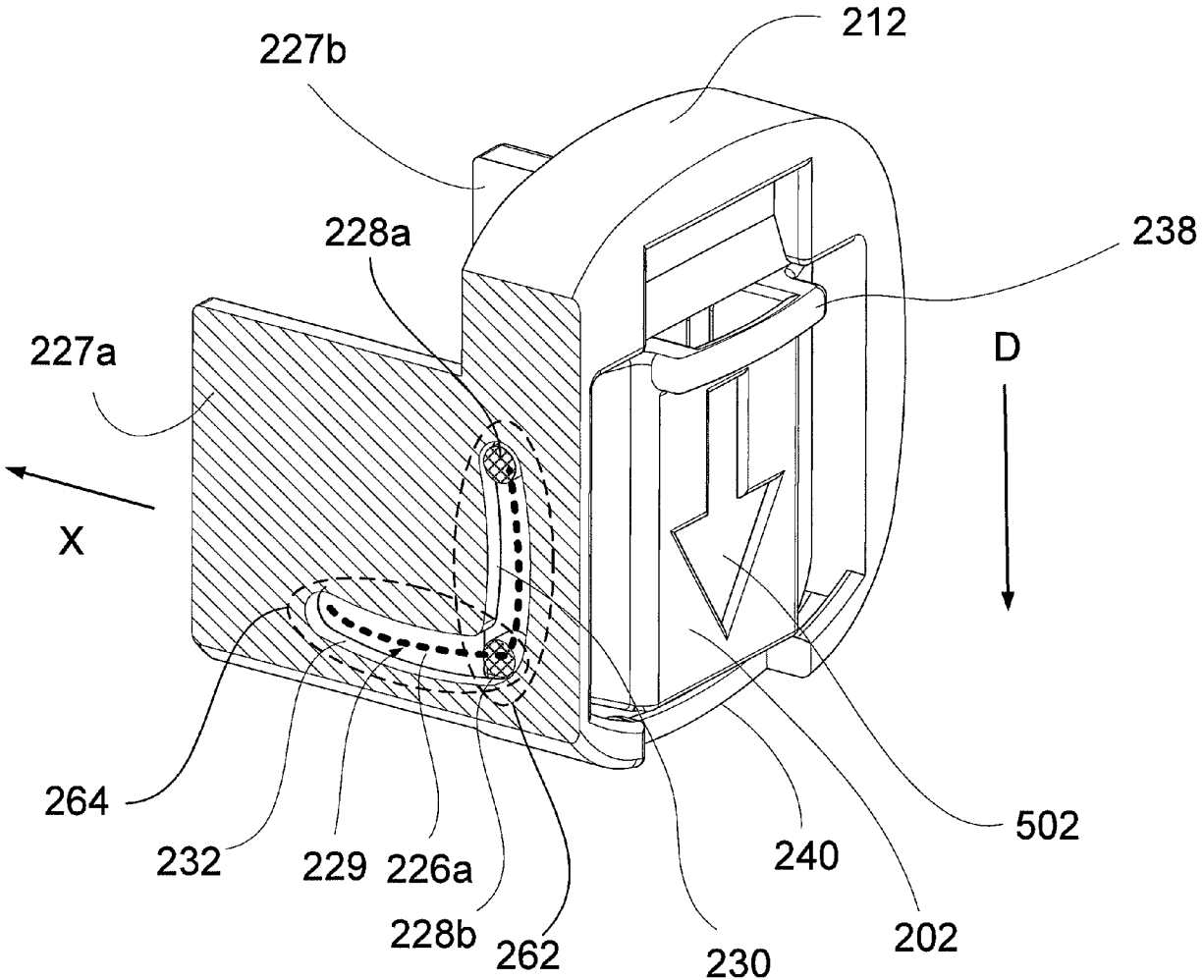
FIG. 7 is a diagrammatic illustration of a perspective view of a cross-section of the electrical connector of FIG. 2, with the door element arranged in the closed position.
Figure 8:
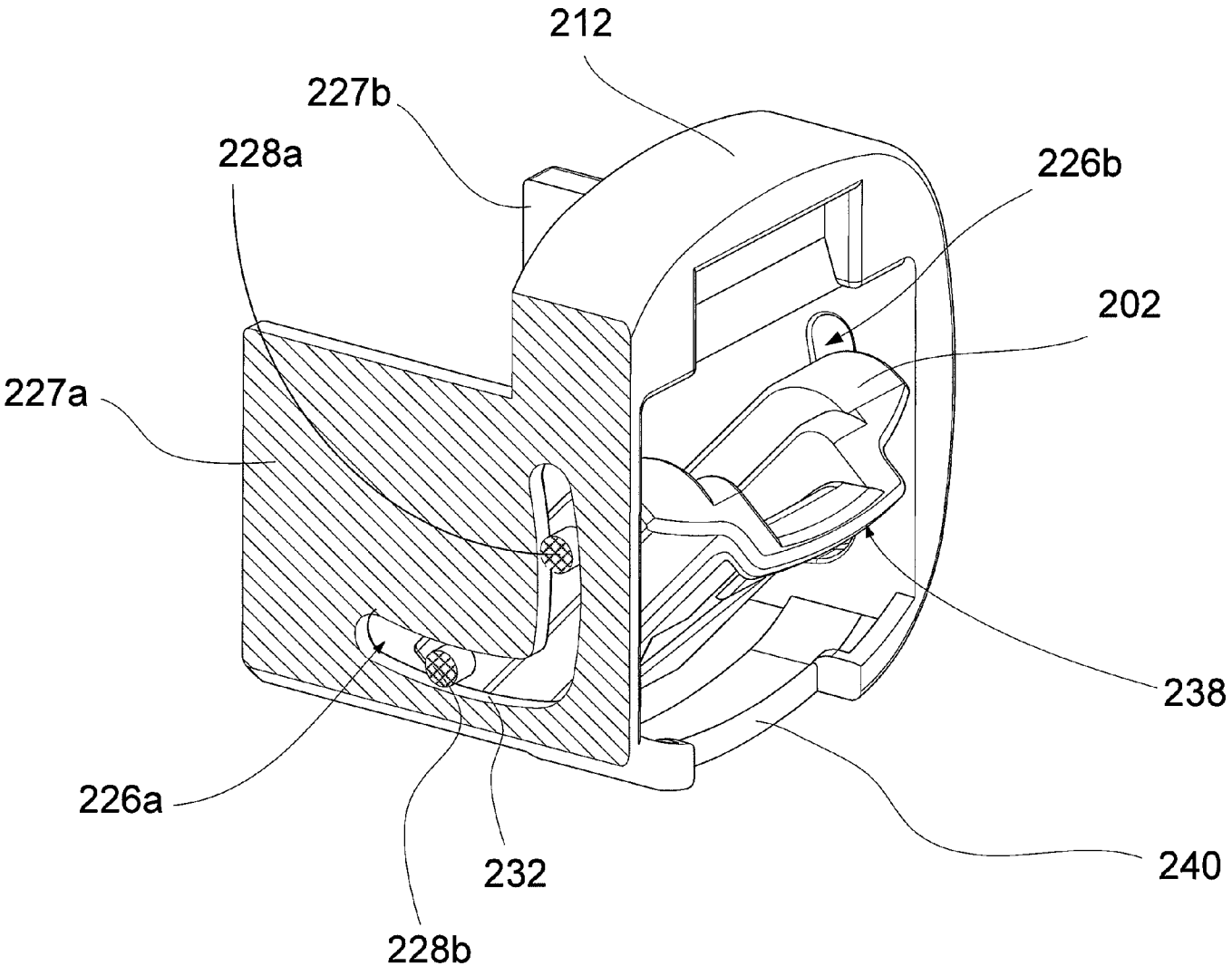
FIG. 8 is a diagrammatic illustration of a perspective view of a cross-section of the electrical connector shown in FIG. 7, with the door element partially open.
Figure 9:
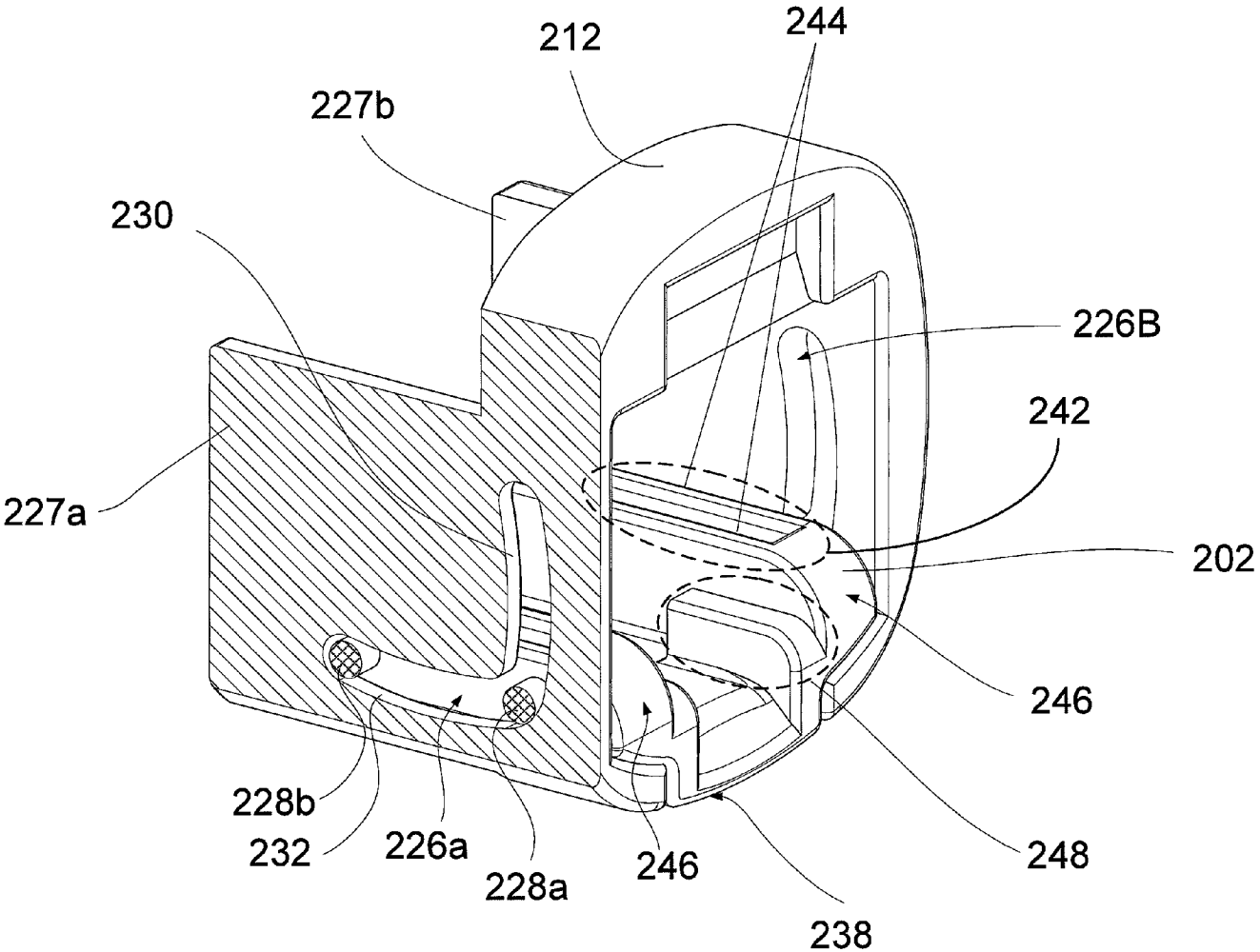
FIG. 9 is a diagrammatic illustration of a perspective of a cross-section of the electrical connector shown in FIG. 7, showing the door element in the open position.

As particularly shown in FIGS. 7 to 9, the insert 212 includes two elongate guides 226*a*, 226*b*, formed in respective the interior walls 227*a*, 227*b*. Each guide 226*a*, 226*b* is shaped to receive outwardly extending substantially parallel pairs of lugs 228*a*, 228*b* of the door element 202. Each pair of lugs 228*a*, 228*b* includes a leading projection 228*a* and a trailing projection 228*b* that are seated between cam surfaces 230 and 232.

Each guide 226*a*, 226*b* has a first portion 262 that extends generally perpendicular to an insertion direction "X" of the socket 206 and a second portion 264 that extends generally parallel to the insertion direction "X".

Thus, the first portion 262 generally extends in a direction that is perpendicular to the direction of extent of the second portion 264. Thus, the closed and open positions of the door element 202 are substantially perpendicular. The paths defined by the first and second portions 262, 264 of the guides 226*a*, 226*b* are generally arcuate. The arcuate curvatures of the first and second portions 262, 264 are substantially equal to allow smooth tracking of the door element 202 over the guides 226*a*, 226*b*. The lugs 228*a*, 228*b* are preferably cylindrical and post-like. The guides 226*a*, 226*b* are substantially slot-like or groove-like.

The mount 204 also includes at least one resilient biasing means 234 seated in a biasing recess 236. The biasing means 234 is preferably a spring 234.

Figure 3:
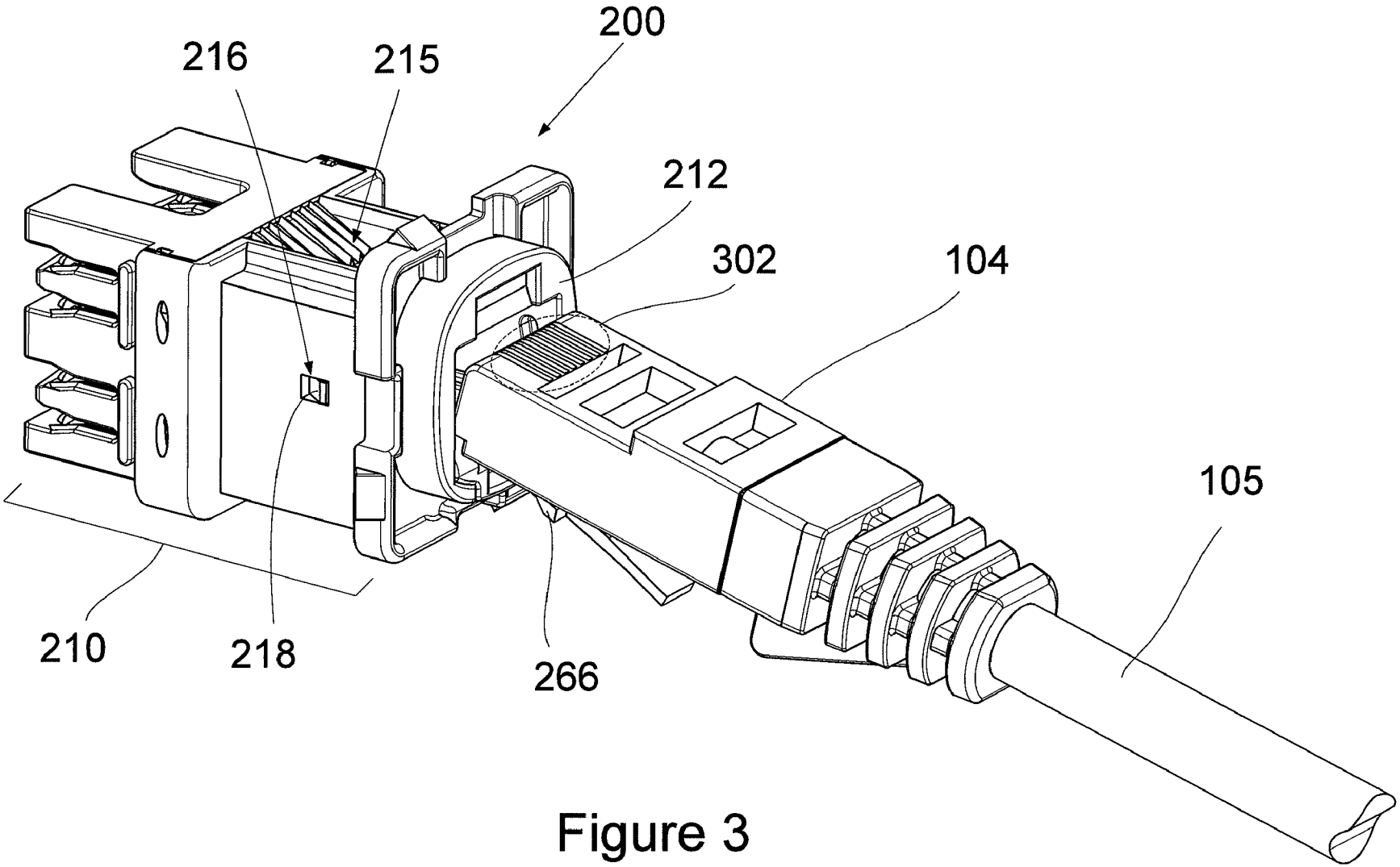
FIG. 3 is a diagrammatic illustration of a perspective view of the electrical connector of FIG. 2 partially coupled to an electrical mating plug.
Figure 4:
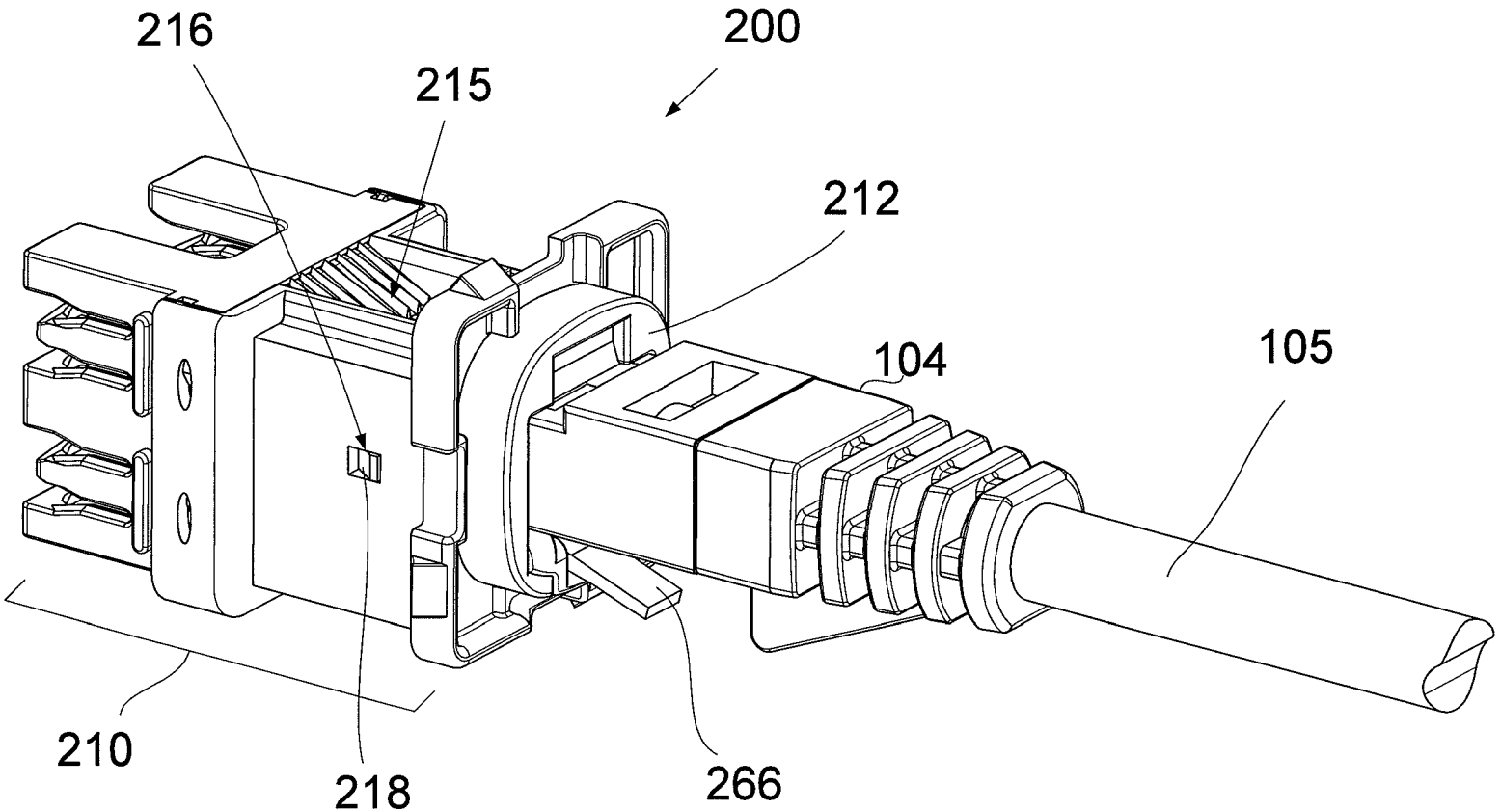
FIG. 4 is a diagrammatic illustration perspective view of the electrical connector shown in FIG. 2 coupled to the mating plug.

As particularly shown in FIG. 7, movement of the lugs 228*a*, 228*b* along corresponding guides 226*a*, 226*b* facilitates translation of the door element 202 between open and closed positions along a nonlinear path 229. The path 229 of guides 226 is aligned to position the door element 202 substantially vertically in the insert 212 when the door element 202 is in the closed position shown in FIGS. 5 and 7. The path 229 of the guide 226 further allows the door element 202 to lie substantially flat in the body of the mount 204 when the door element 202 is in the open position shown in FIGS. 6 and 9. When the door element 202 is in the closed position, the exposed socket 206 is substantially covered. When the door element 202 is in the open position, the exposed socket 206 is substantially open. An electrical plug 104 may be received by the socket 206 when so arranged, as shown in FIGS. 3 and 4. The path 229 of the guides 226 is further adapted to allow movement between open and closed positions with a reasonable amount of force required to translate the door element 202 along its nonlinear path 229. That is, sufficient force to overcome a resilient bias effected by a spring 234.

When a downward force "D" is applied to the closed door element 202, the trailing lugs 228*b* are forced by the caming surfaces 232 of the guides 226*a*, 226*b* in direction "X" along the second portion 264 of the guides 226*a*, 226*b*. At the same time, the leading lugs 228*a* are forced along respective first portions 262 of the guides 226*a*, 226*b* generally in the direction "D" (i.e. downwards). The leading lugs 228*a* have an additional component of movement perpendicular to the applied force in direction "D" following the outward curve of the first portion 262. As further force is applied in a downwards direction "D", the door element 202 swings along the nonlinear sliding path 229 into the open position. An advantage of this arrangement is that a downward force on the closed door element initiates backward motion of the trailing lugs 228*b*, in a direction "X" perpendicular to the applied force.

The path 229 is defined by two arcuate lines (i.e. first and second portions 262 and 264 of guides 226*a*, 226*b*), generally at right angles to each other, and joining at a point. The first portions 262 are arcuate about a central point defined by the position of the resilient biasing means 234.

As above described, the door element 202 is inserted into the insert 212 by spreading the naturally resilient arms 220*a*, 220*b* of insert 212 and inserting the door element 202 between the arms 220 such that lugs 228*a*, 228*b* are seated in guides 226*a*, 226*b*, as shown in FIGS. 7 to 9.

The resilient biasing means 234 biases the door element 202 in the nonlinear path 229 defined by guides 226*a*, 226*b* to move towards the closed position shown in FIG. 5. The door element 202 may be guided along the nonlinear sliding path 229 defined by guides 226*a*, 226*b* through the application of an external force to resist the biasing force applied by resilient biasing means 234. As particularly shown in FIG. 5, the door element 202 includes an instructional feature 502 in the form of an arrow, for example, that indicates the approximate direction in which force must be applied to translate the door 202 along guides 226*a*, 226*b* to open the door. The direction "D" of the opening force is indicated by instructional feature 502 and may be applied to a ledge 238. The ledge 238 may be in the form of a handle, formed integrally with the door element 202. The ledge 238 allows a force to be applied in the plane of the door element 202 by a finger, or the leading end (i.e. the end to be inserted) of a connector such as the electrical plug 104 shown in FIGS. 10*a* to 10*d*.

When the door element 202 is in the open position, as shown in FIG. 6, the ledge 238 may rest in a recess 240 in mount 204. By resting the ledge 238 in recess 240 the door element 202 is able to lie flush with the plane defined by the front (i.e. in the direction from which an electrical plug 104 may be inserted) surface of the mount 204.

Figure 11:
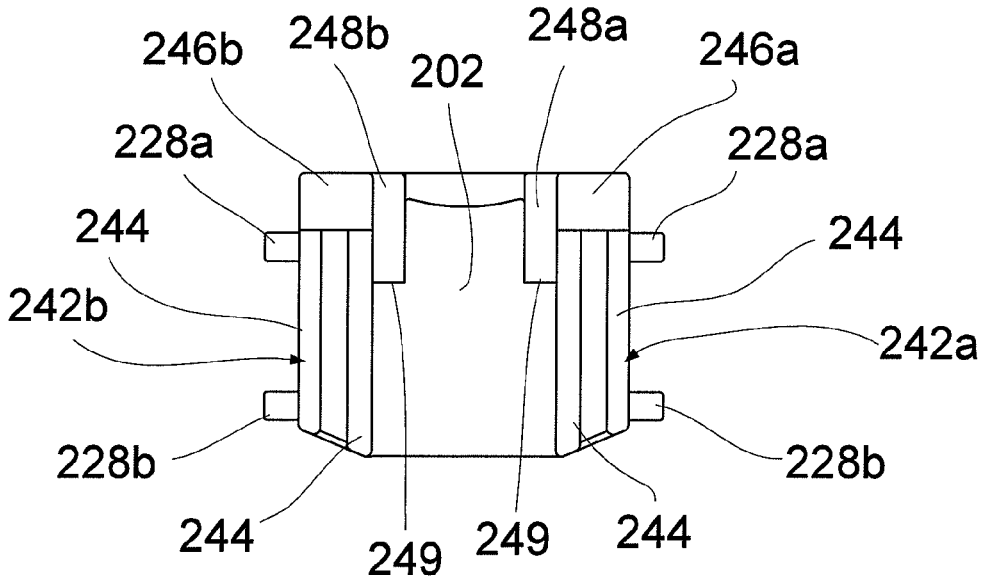
FIG. 11 is a diagrammatic illustration of a back view of the door element of the connector shown in FIG. 2.
Figure 12:
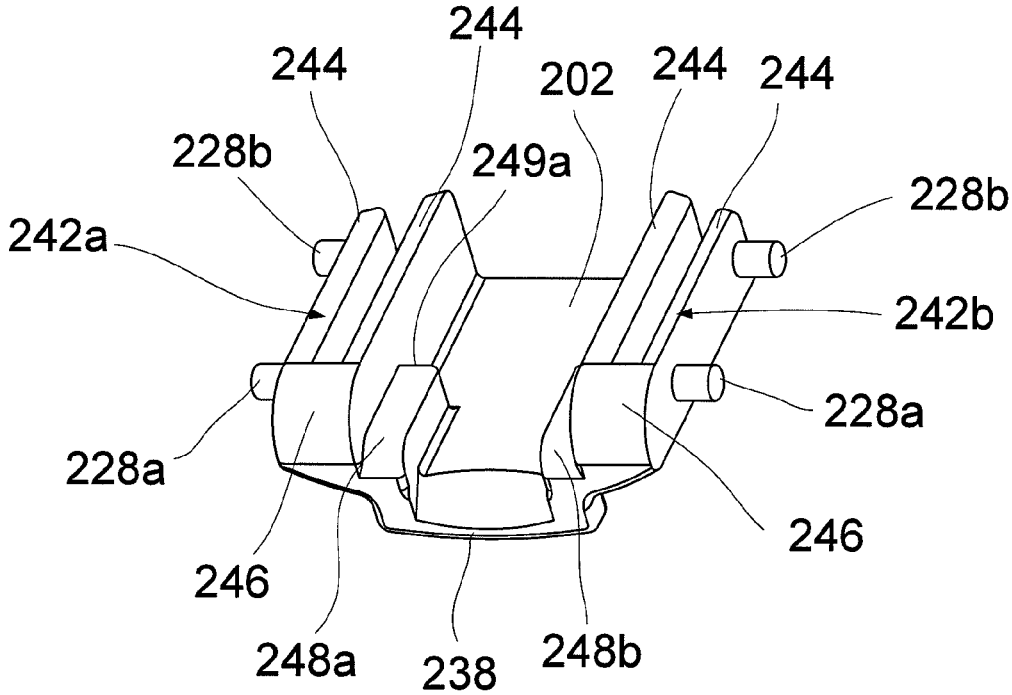
FIG. 12 is a diagrammatic illustration of a perspective view of the back side of the door element in FIG. 11.
Figure 13:
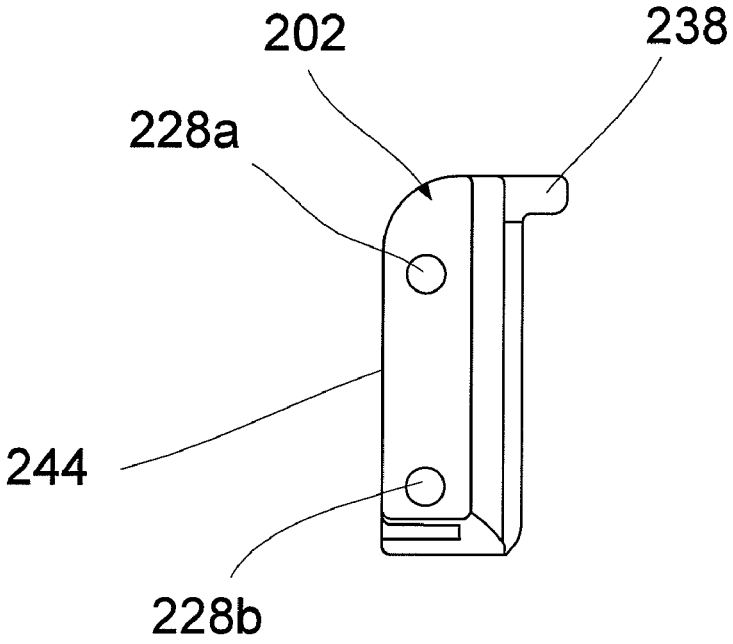
FIG. 13 is a diagrammatic illustration of a side view of the door element in FIG. 11.
Figure 14:
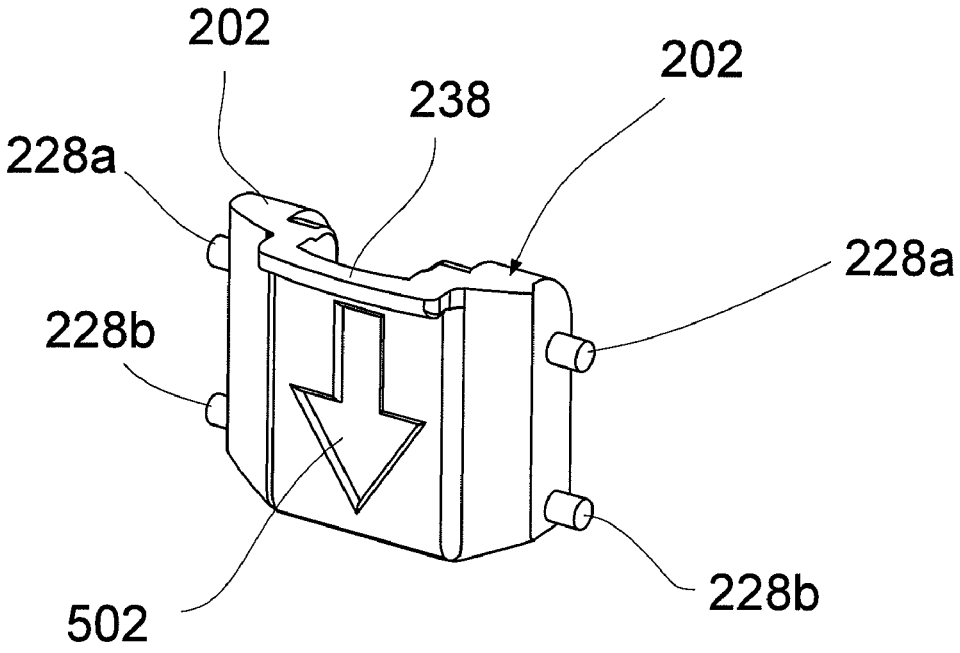
FIG. 14 is a diagrammatic illustration of a perspective view of the front of the door element in FIG. 11.
Figure 15:
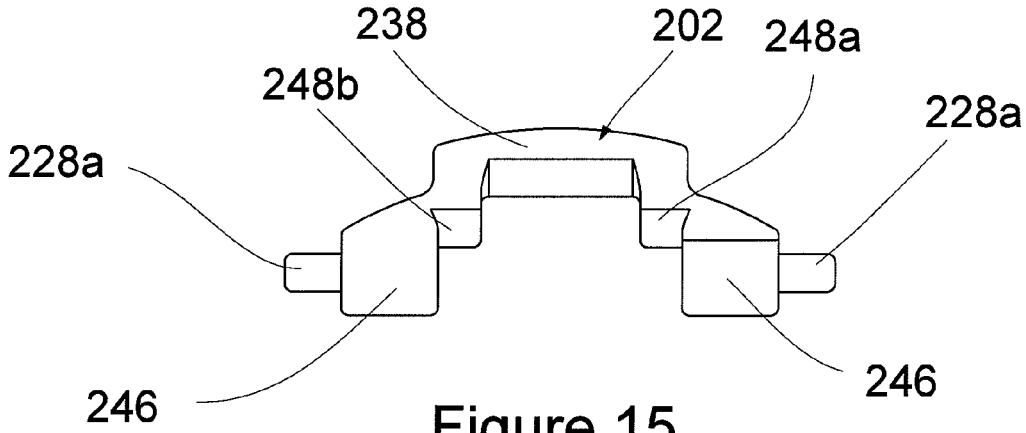
FIG. 15 is a diagrammatic illustration of top view of the door element in FIG. 11.
Figure 16:
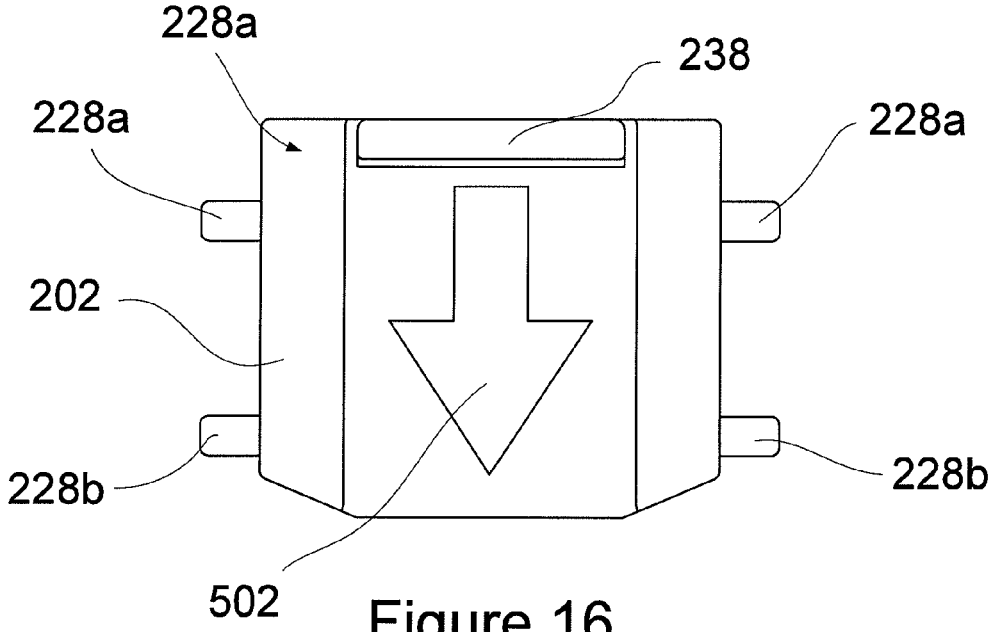
FIG. 16 is a diagrammatic illustration of a front view of the door element in FIG. 11.
Figure 17:
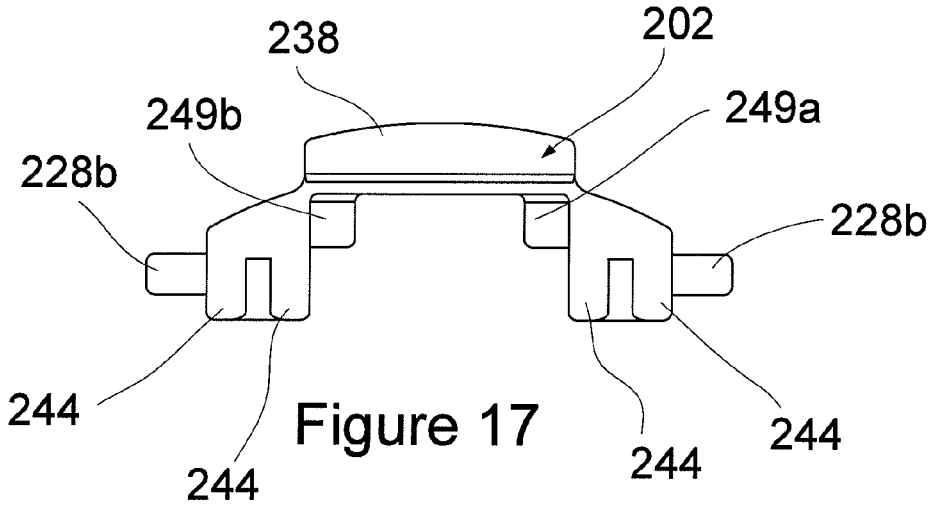
FIG. 17 is a diagrammatic illustration of a bottom view of the door element of FIG. 11.
Figure 18:
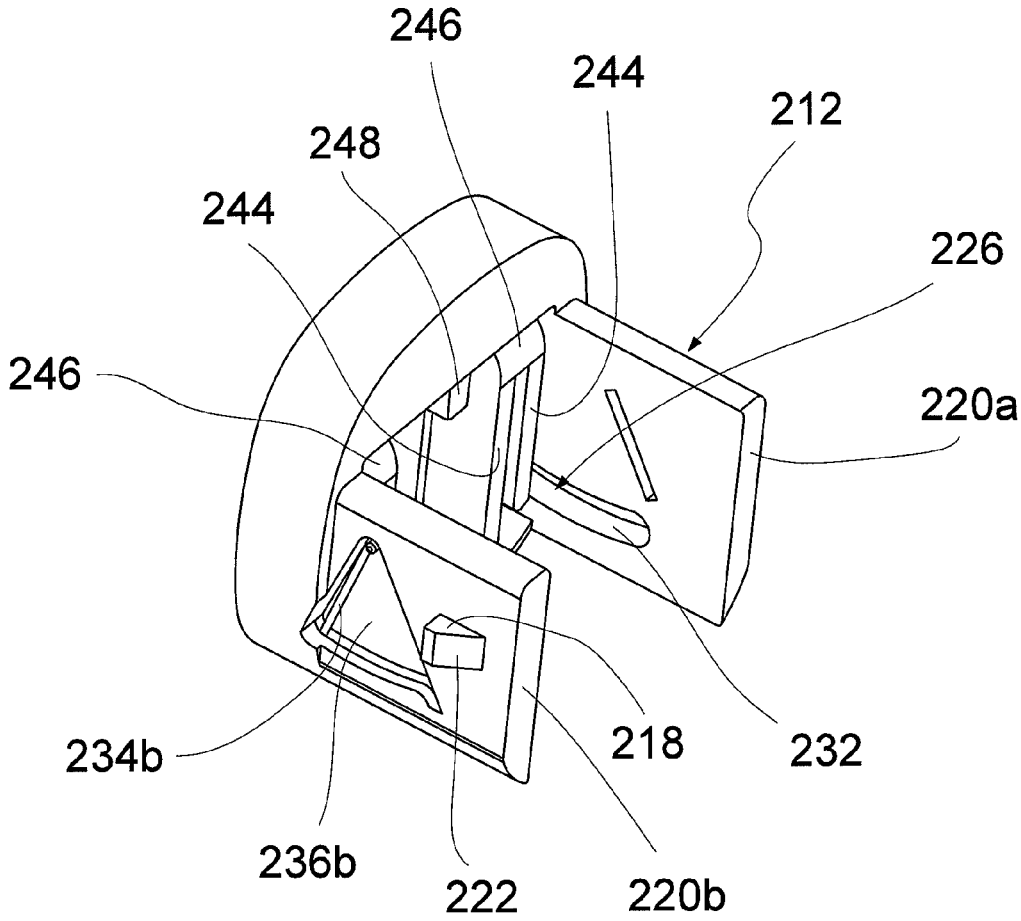
FIG. 18 is a diagrammatic illustration of a perspective view of the door element and the insert of the connector shown in FIG. 2.
Figure 19:
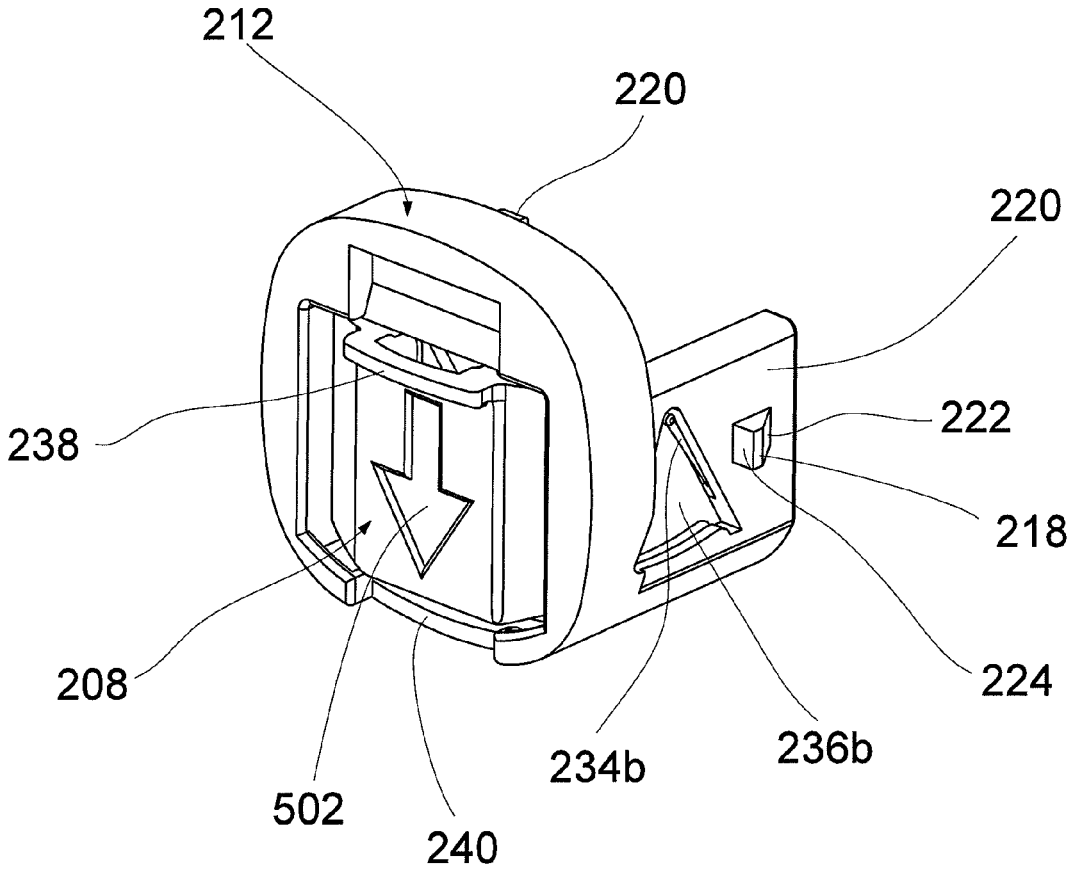
FIG. 19 is a diagrammatic illustration of another perspective view of the door element and the insert shown in FIG. 18.
Figure 20:
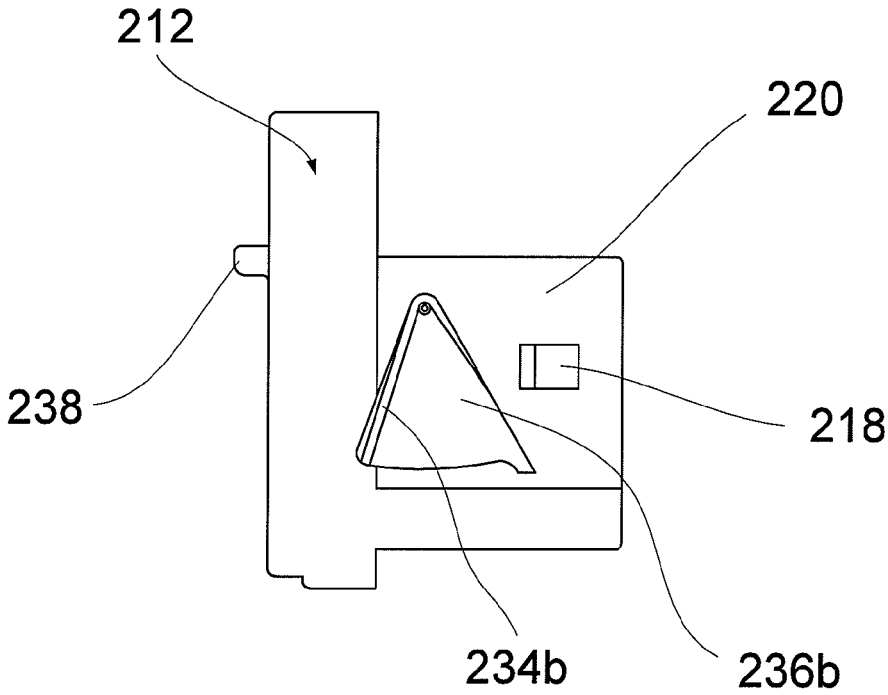
FIG. 20 is a diagrammatic illustration of a side view of the door element and the insert shown in FIG. 18.
Figure 21:
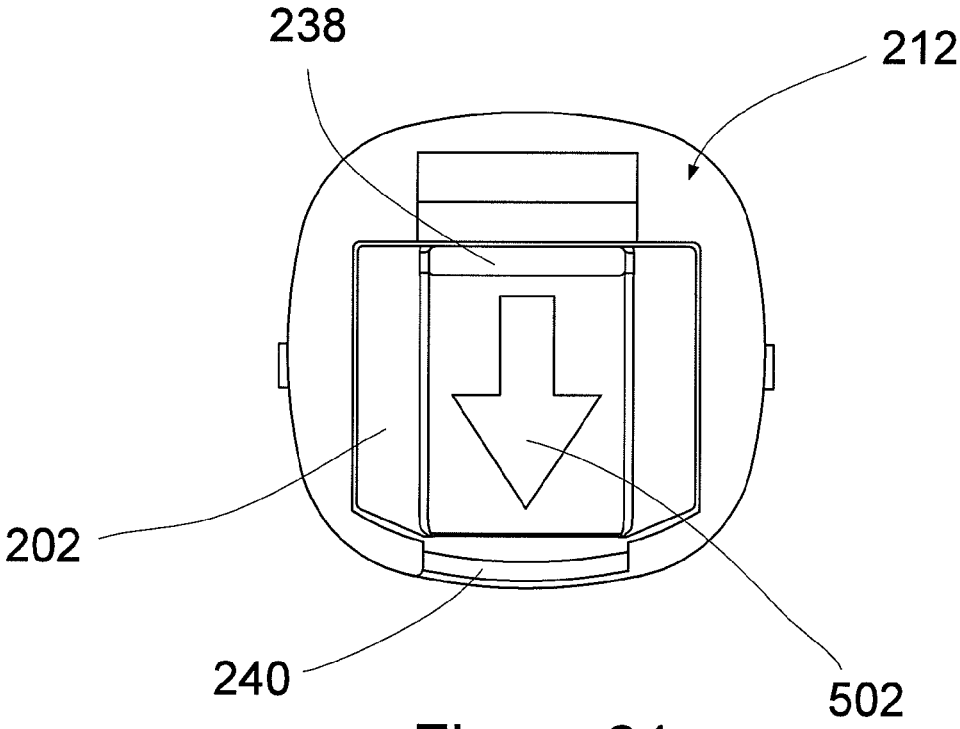
FIG. 21 is a diagrammatic illustration of a front view of the door element and the insert shown in FIG. 18.

As particularly shown in FIGS. 11 and 12, the door element 202 includes guides 242*a*, 242*b* with caming surfaces 244 that guide an electrical connector, such as electrical plug 104, when the electrical connector is slideably inserted into the socket 206 of the electrical connector 200. The guides 242*a*, 242*b* also include curved guiding surfaces 246*a*, 246*b* to ease the entry of a mating plug, for example electrical plug 104, into the socket 206 of electrical connector 200.

Figure 10A:
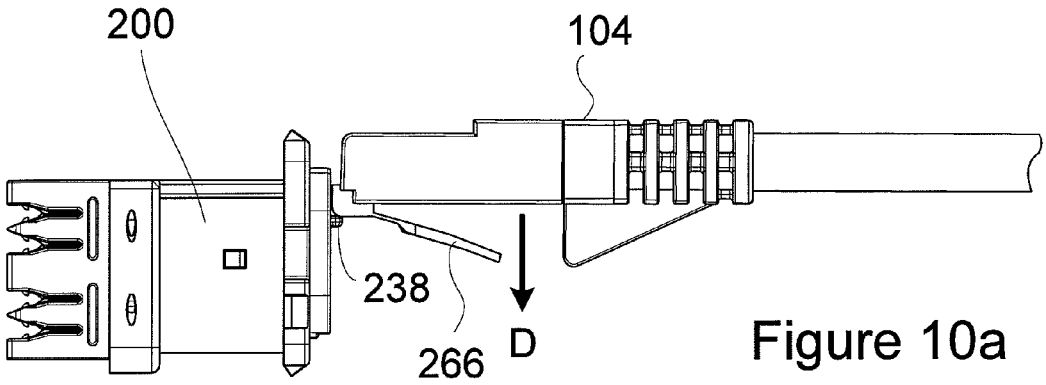
FIGS. 10A to 10D are diagrammatic illustrations of side views of the electrical connector of FIG. 2, showing steps in insertion of a mating plug thereinto.
Figure 10B:
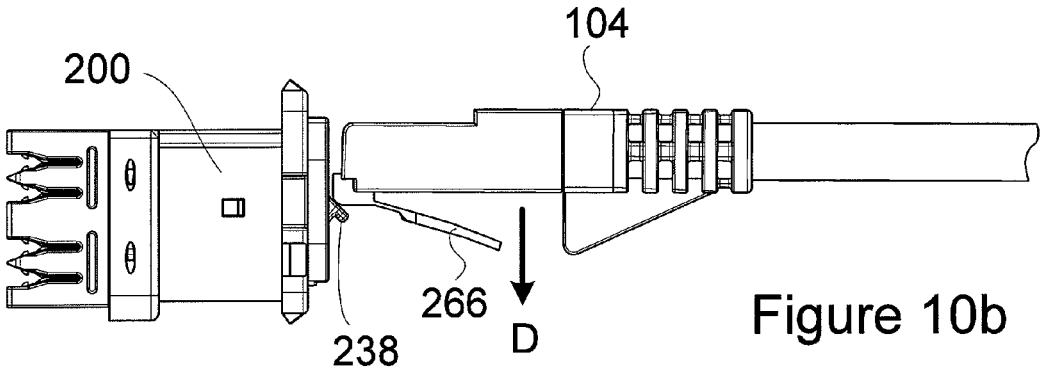
Figure 10C:
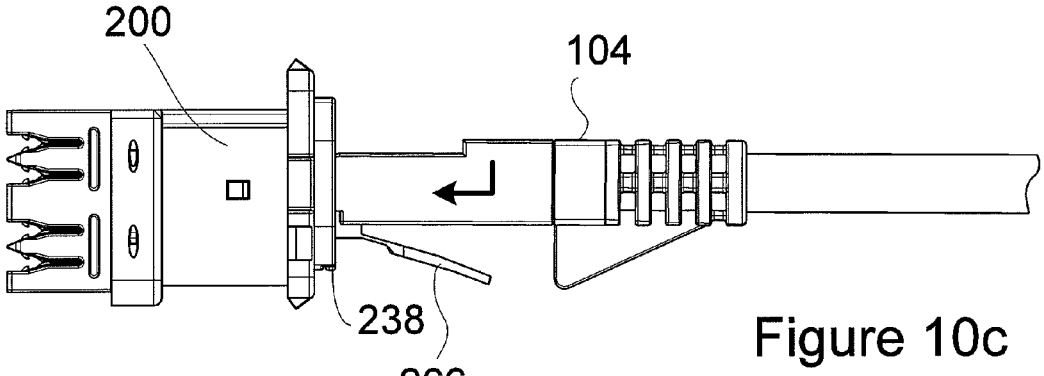

FIGS. 10*a* to 10*d* show, in four stages, how an electrical plug 104 may translate the sliding door element 202 by applying a force to ledge 238. In FIG. 10*a*, the mating plug 104 applies a downward force "D" to door element 202 by contact with ledge 238. In FIG. 10*b*, downward (i.e. in the direction of an arrow 268) motion of mating plug 104 has moved door element 202 along, defined by the travel of lugs 228 in guides 226, to a partially open position (the position in FIG. 10*b* corresponds approximately to the position of door element 202 shown in FIG. 8). In FIG. 10*c*, sufficient downward translation has been applied by mating plug 104 to shift door element 202 into an open position (the position of door element 202 in FIG. 10*c* corresponds substantially to the open position shown in FIG. 9). With the door element 202 in the open position, the mating plug 104 may be fully inserted into the electrical connector 200 by the application of a force in direction "X" into the electrical connector 200. When fully inserted into the connector 200, the conductive elements 302 on mating plug 104 are able to engage with the contact elements 215 of the electrical conductors in connector 200.

Figure 10D:
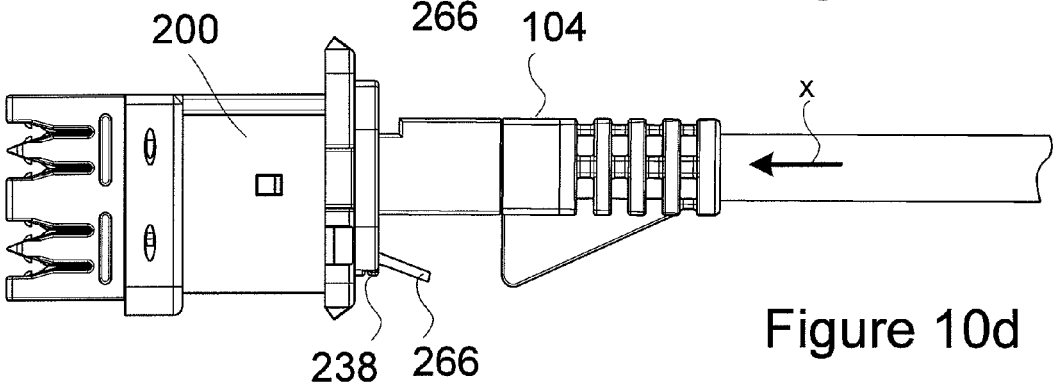

As particularly shown in FIGS. 11 to 17, the door element 202 further includes guiding lugs 248*a*,248*b* lying exposed when the door element 202 is in the open position. These guiding lugs 248*a*,248*b* act to guide a mating electrical connector (for example electrical plug 104) during insertion, and in addition to provide locking surfaces 249*a*,249*b*. The locking surfaces 249*a*,249*b* may engage with an example locking clip 266 on an example electrical plug 104 when the electrical connector is substantially fully inserted in the electrical connector 200 (as seen in FIGS. 4 and 10D). The locking surfaces 249*a*,249*b* of guiding lugs 248*a*,248*b* advantageously resist removal of a mating plug 104 from the electrical connector 200 in the case when the locking clip 266 has not been fully actuated (e.g. squeezed to the body of the electrical plug 104).

Figure 22:
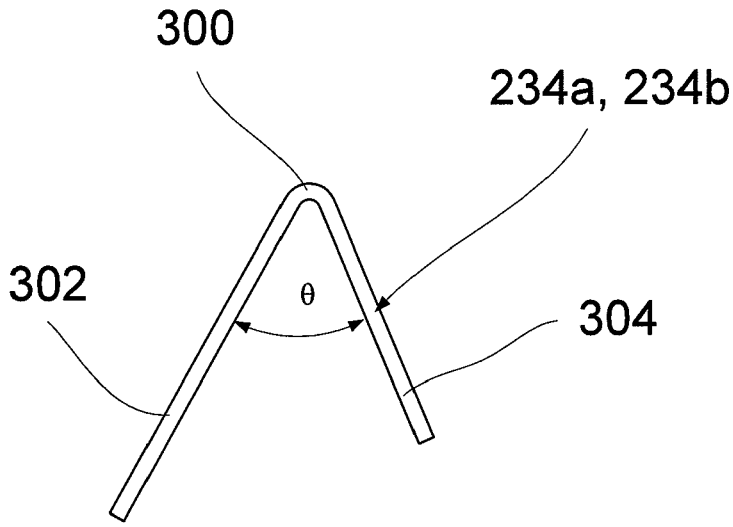
FIG. 22 is a diagrammatic illustration of a side view of a biasing means of the electrical connector shown in FIG. 2 arranged in a condition of use.
Figure 23:
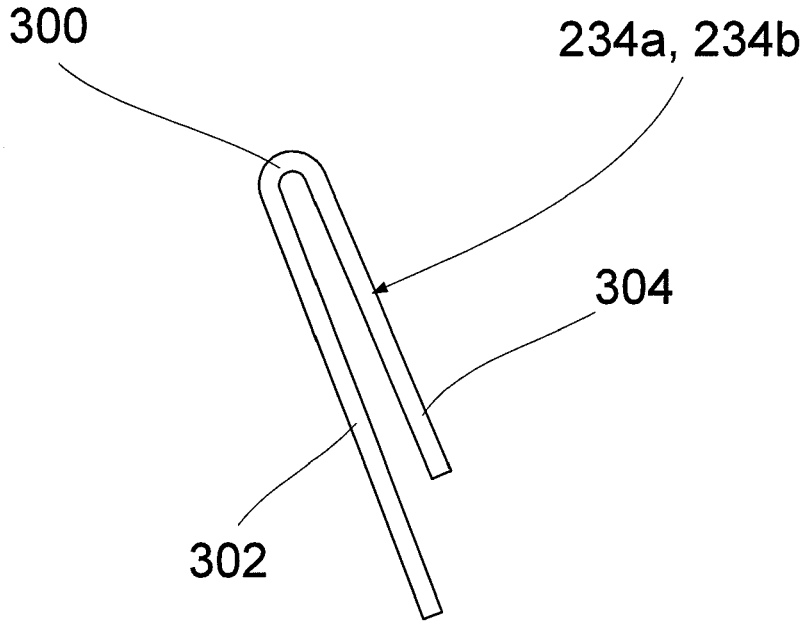
FIG. 23 is a diagrammatic illustration of a side view of the biasing means shown in FIG. 22 arranged in an another condition of use.

As particularly shown in FIGS. 18 to 21, outer sides of walls 220*a*, 220*b* of the insert 212 each include a generally triangular recess 236*a*, 236*b*. The biasing means 236 preferably includes two resiliently compressible springs 234*a*, 234*b* of the type shown in FIGS. 22 and 23. The springs 234*a*, 234*b* are formed of an elongate strip of metal that is bent at an elbow 300. First and second arms 302, 304 of the springs 236*a*, 236*b* extend outwardly from respective elbows 300. In a neutral, relaxed, condition of use, the first and second arms 302, 304 are separated by angle θ. In this condition of use, θ is 45 degrees, for example. The arms 302, 204 are adapted to resiliently bend about respective elbows 300 to move from the relaxed state shown in FIG. 22 towards the compressed state shown in FIG. 23.

The elbow 300 of each spring 234*a*, 234*b* is seated in the apex of the corresponding triangular recess 236*a*, 236*b*. In this position, the springs 234*a*, 234*b* resiliently bear against the side walls of the recesses 236*a*, 236*b* and are thereby resiliently held in position. As particularly shown in FIG. 20, the recesses 236*a*, 236*b* also include lugs 306. The elbows 300 of each spring 234*a*, 234*b* are seated on respective protections 306 in the recesses 236*a*, 236*b*.

First arms 302 of the springs 234*a*, 234*b* extend from respective elbows down into corresponding second sections 264 of the guides 226*a*, 226*b*. The first arms 302 of the springs 234*a*, 234*b* are adapted to track along the second sections 264 of the guides 226*a*, 226*b* so as to move towards respective second arms 304. Movement of the first arms 302 away from the second arms 304 is restricted by the internal walls of the triangular recesses 236*a*, 236*b*. As above described, movement of the door element 202 from the closed position shown in FIG. 7, towards the open position shown in FIG. 9, causes the lugs 228*a*, 228*b* to track along respective guides 226*a*, 226*b*. In doing so, the trailing lugs 228*b* engage first arms 302 of corresponding springs 234*a*, 234*b* and resiliently force the arms 302, 304 of the springs 234*a*, 234*b* together. The door element 202 thereby moves towards the open position shown in FIG. 9 under a spring bias. The springs 234*a*, 234*b* resiliently act to maintain the door in the closed condition of use shown in FIG. 7.

Figure 24:
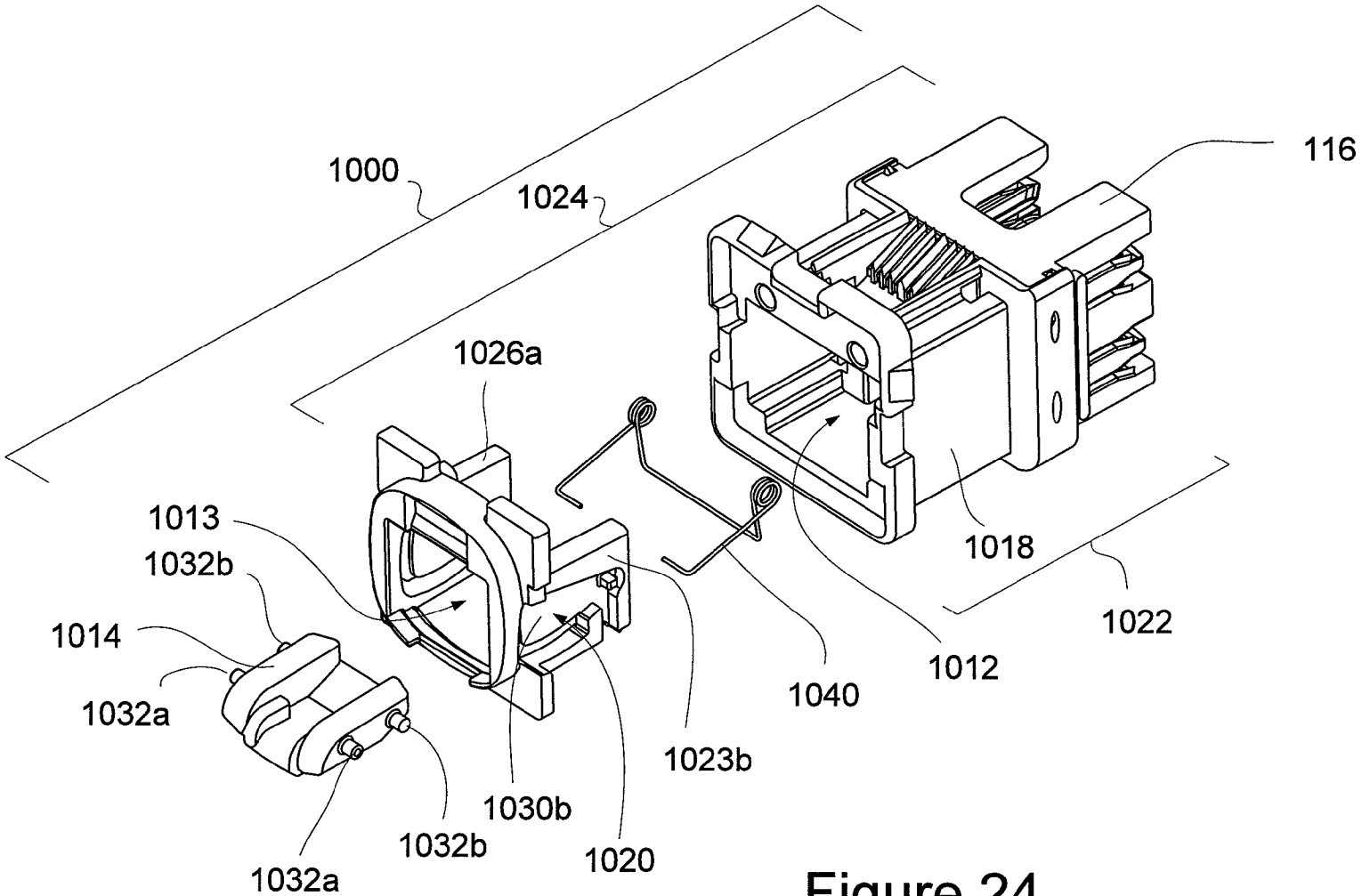
FIG. 24 is diagrammatic illustration of an exploded perspective view of another electrical connector in accordance with a preferred embodiment of the invention.

The electrical connector 1000 shown in FIG. 24 is an RJ-type connector, for example, that includes a socket 1013 shaped to receive a mating plug (not shown); electrically conductive contact elements (not shown) arranged to at least partially extend into the socket 1013 for electrical coupling to corresponding electrically conductive contacts of the plug; and a door element 1014 that is arrangeable between open and closed positions. The door 1014 inhibits access to the electrically conductive contacts when arranged in the closed position. The door element 1014 is mounted for sliding movement on a nonlinear path from the closed to the open position pursuant to engagement by and movement of the mating plug to insert it into the socket 1013. The connector 1000 functions in an analogous manner to the connector 200 shown in FIG. 2, for example.

The connector door element 1014 advantageously inhibits access to the electrically conductive elements arranged in the socket by you children, for example. The connector door element 1014 advantageously does not need additional space on the face of the connector to accommodate the door.

The electrical connector 1000 is described hereafter in further detail. The connector 1000 includes the following parts:

1. A pedestal portion 1016 with pedestals for seating insulation displacement contacts (IDCs) (not shown);

2. A central portion 1018, slideably coupled to the pedestal portion 1016. The parts 1016, 1018 are slidably coupleable together;

3. An insert 1020 that is slideably seated in the central portion 1018 through aperture 1012; and 4. A door element 1014 that is seated in the insert 1020.

The pedestal portion 1016 and central portion 1018 form a body 1022 for the insert 1020. The body 1022 and insert 1020 form a mount 1024 for the door element 1014.

Figure 25:
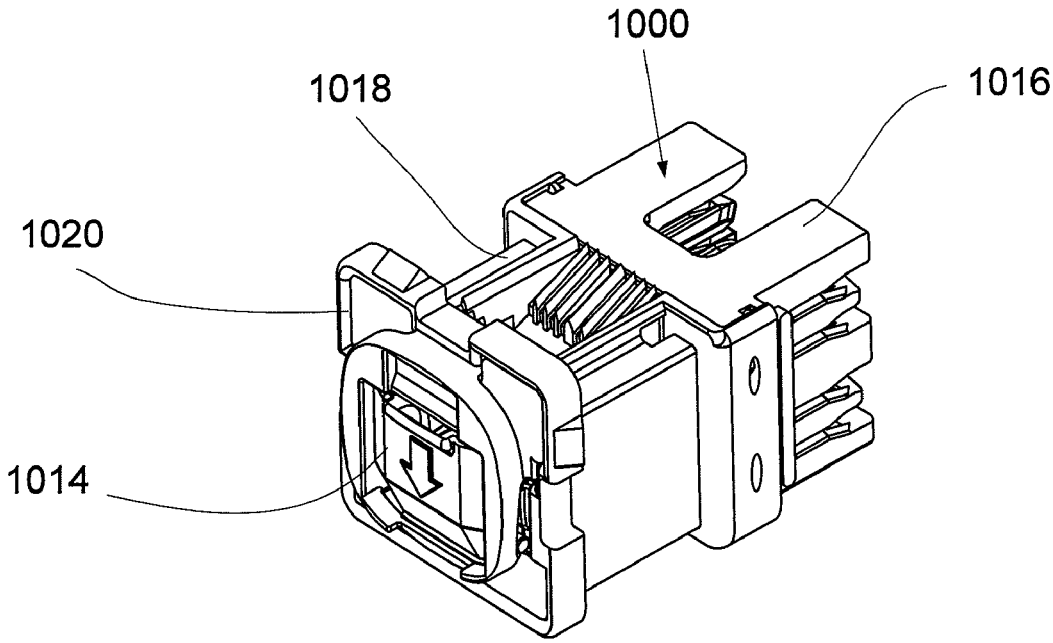
FIG. 25 is a diagrammatic illustration perspective view of the electrical connector show in FIG. 24 showing the door element in a closed condition of use.
Figure 26:
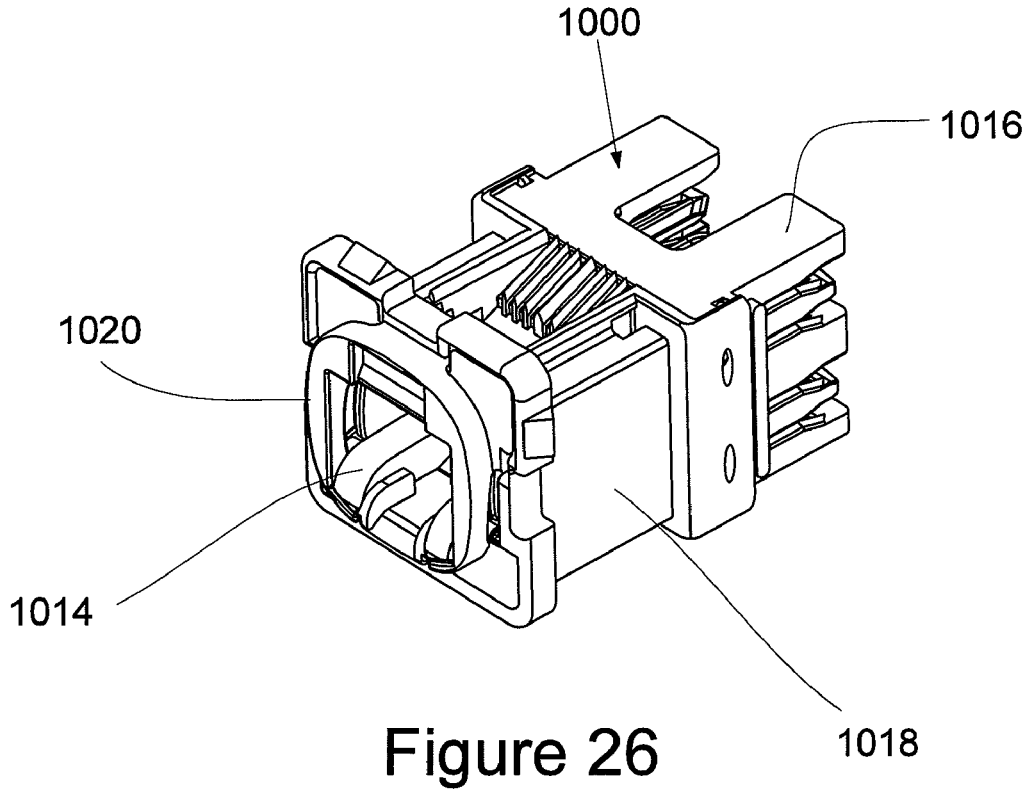
FIG. 26 is a diagrammatic illustration of a perspective view of the electrical connector shown in FIG. 24 showing the door element in an open condition of use.

The door element 1014 is movable between the closed position shown in FIG. 25 and the open position shown in FIG. 26. In the open position, the socket 1013 is exposed to allow insertion of an electrical mating plug, e.g. an RJ-type mating plug, which electrically contacts the contact elements. In the closed position, the socket 1013 is substantially covered, thereby inhibiting access to the contact elements.

As particularly shown in FIG. 24, the body 1022 of the mount 1024 is shaped to receive, and at least partially seat therein, the insert 1020 through the aperture 1012. The insert 1020 includes locking arms 1026*a*, 1026*b* for securing the insert 1020 in the aperture 1012 of the body 1022.

Figure 27:
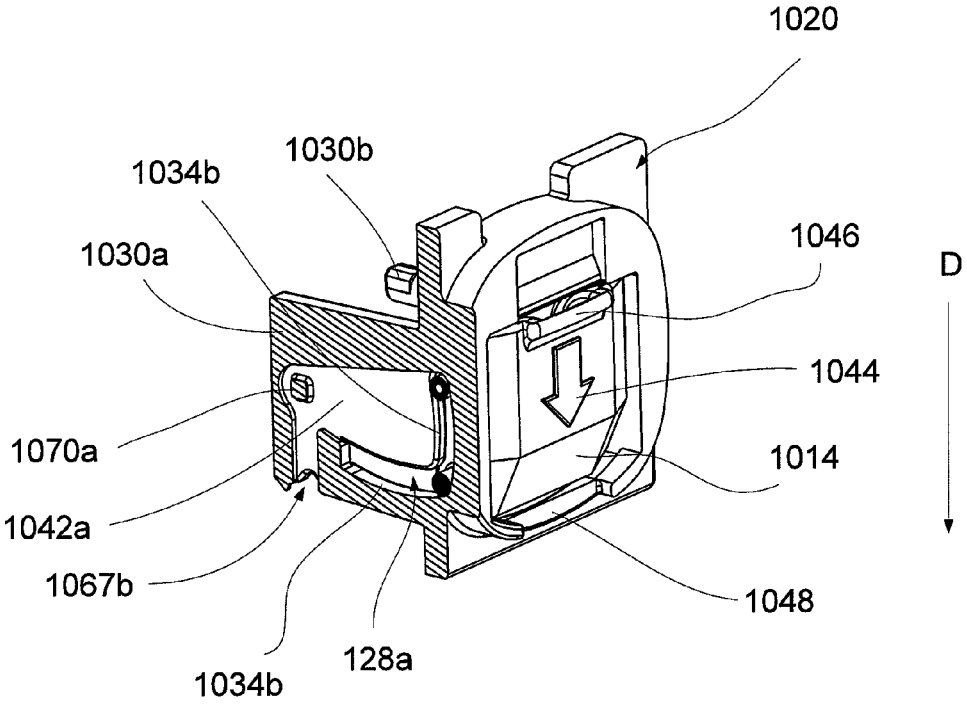
FIG. 27 is a diagrammatic illustration of a perspective view of a cross-section of the electrical connector of FIG. 24, with the door element arranged in the closed position.
Figure 28:
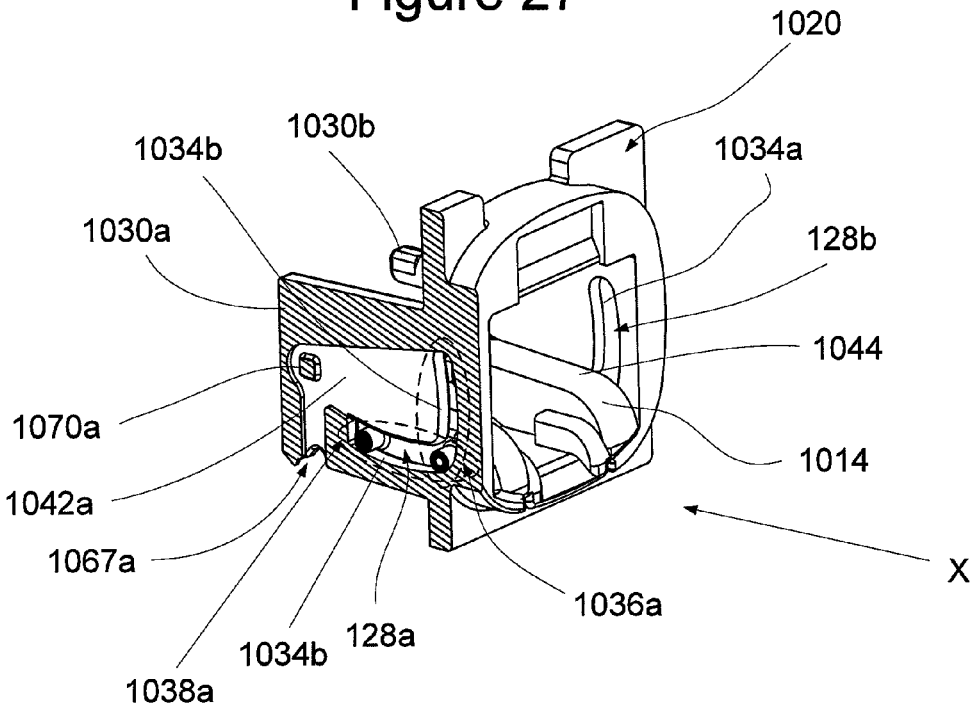
FIG. 28 is a diagrammatic illustration of a perspective view of a cross-section of the electrical connector shown in FIG. 27, with the door element partially open.
Figure 29:
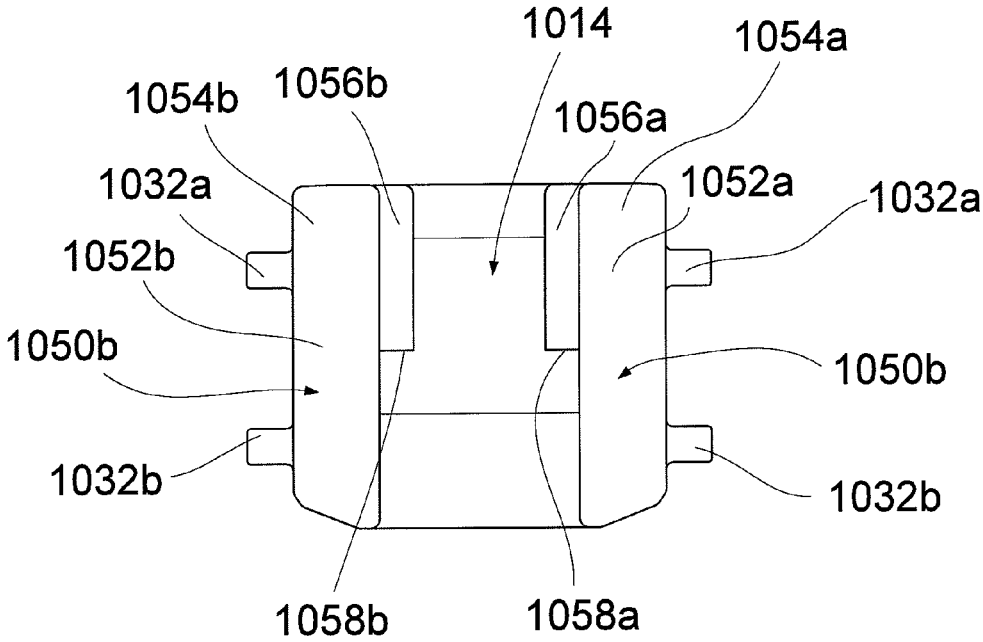
FIG. 29 is a diagrammatic illustration of a back view of the door element of the connector shown in FIG. 24.
Figure 30:
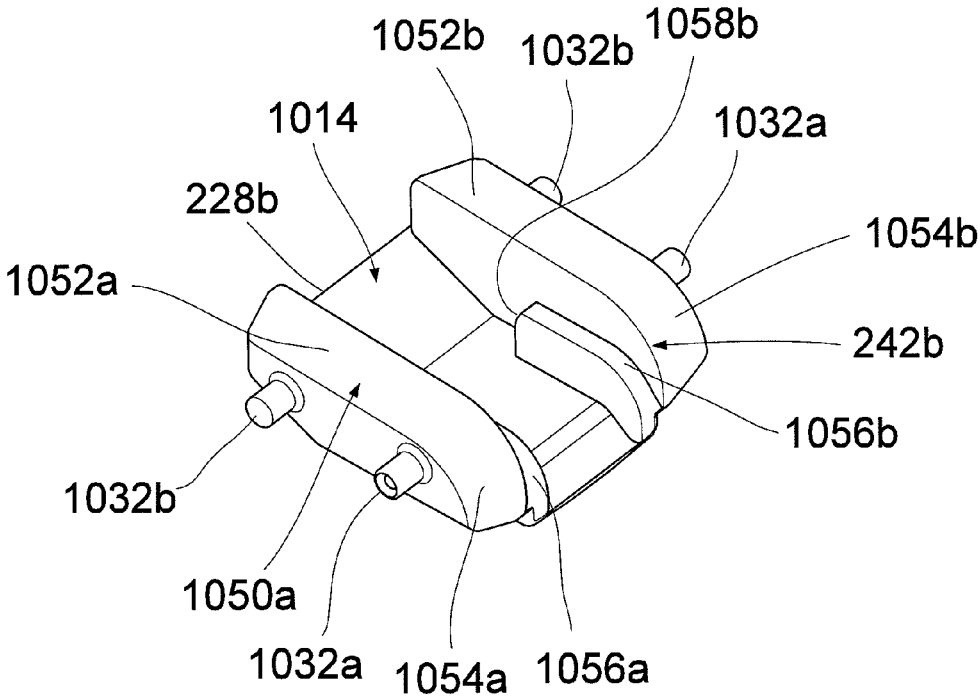
FIG. 30 is a diagrammatic illustration of a perspective view of the back side of the door element shown in FIG. 29.
Figure 31:
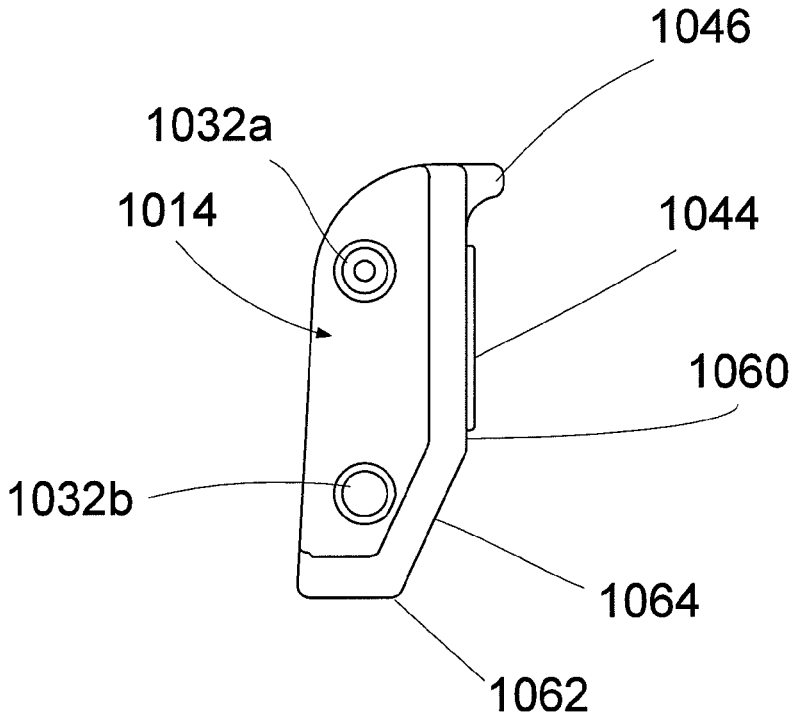
FIG. 31 is a diagrammatic illustration of a side view of the door element in FIG. 29.

As particularly shown in FIGS. 27 and 28, the insert 1020 includes two elongate guides 1028*a*,1028*b* formed in respective the side walls 1030*a*, 1030*b*. Each guide 1028*a*, 1028*b* is shaped to receive outwardly extending substantially parallel pairs of lugs 1032*a*, 1032*b* of the door element 1014. Each pair of lugs 1032*a*, 1032*b* includes a leading projection 1032*a* and a trailing projection 1032*b* that are seated between cam surfaces 1034*a*, 1034*b*.

Each guide 1028*a*, 1028*b* has a first portion 1036*a*, 1036*b* that extends generally perpendicular to an insertion direction "X" of the socket 1013, and a second portion 1038*a*, 1038*b* that extends generally parallel to the insertion direction "X". Thus, the first portions 1036*a*, 1036*b* generally extend in a direction that is perpendicular to the direction of extent of the second portions 1038*a*, 1038*b*. Thus, the closed and open positions of the door element 202 are substantially perpendicular. The paths defined by the first and second portions 1036*a*, 1036*b*, 1038*a*, 1038*b* of the guides 1028*a*, 1028*b* are generally arcuate. The arcuate curvatures of the first and second portions 1036*a*, 1036*b*, 1038*a*, 1038*b* are substantially equal to allow smooth tracking of the door element 1014 over the guides 1028*a*, 1028*b*. The lugs 1032*a*.1032*b* are preferably cylindrical and post-like. The guides 1028*a*, 1028*b* are substantially slot-like or groove-like.

The mount 1024 also includes a resilient biasing means 1040 seated in a biasing recess. The biasing means 1040 is preferably a spring. The biasing means 1040 is later described in further detail.

As particularly shown in FIG. 27, movement of the lugs 1032*a*, 1032*b* along corresponding guides 1028*a*, 1028*b* facilitates translation of the door element 1014 between open and closed positions along a nonlinear path. The nonlinear path of guides 1028*a*, 1028*b* is aligned to position the door element 1014 substantially vertically in the insert 1020 when the door element 1014 is in the closed position shown in FIG. 27. The nonlinear path of the guide 1028*a*, 1028*b* further allows the door element 1014 to lie substantially flat in the body of the mount 1022 when the door element 1014 is in the open position shown in FIG. 28. When the door element 1014 is in the closed position, the socket 1013 is substantially covered. When the door element 1014 is in the open position, the socket 1013 is substantially laid open. When so arranged, an electrical plug may be received by the socket 1013. The nonlinear path of the guides 1028*a*, 1028*b* is further adapted to allow movement of the door 1014 between open and closed positions with a reasonable amount of force required to translate the door element 1014 along its nonlinear path. That is, sufficient force to overcome a resilient bias effected by a spring 1040.

When a downward force in direction "D" is applied to the closed door element 1014, the trailing lugs 1032*b* are forced by the caming surfaces 1034*a*, 1034*b* of the guides 1028*a*, 1028*b* in direction "X" along the second portions 1038*a*, 1038*b* of the guides 1028*a*, 1028*b*. At the same time, the leading lugs 1032*a* are forced along respective first portions 1036*a*, 1036*b* of the guides 1028*a*, 1028*b* generally in the direction "D" (i.e. downwards). The leading lugs 1032*a* have an additional component of movement perpendicular to the applied force in direction "D" following the outward curve of the first portions 1036*a*, 1036*b*. As further force is applied in a downwards direction "D", the door element 202 swings along the nonlinear path into the open position. An advantage of this arrangement is that a downward force on the closed door element initiates backward motion of the trailing lugs 1032*b* in a direction "X" perpendicular to the applied force.

As above described, the door element 1014 is coupled to the insert 1020 by spreading the resilient arms 1026*a*, 1026*b* of the insert 1014 and arranging the door element 1014 between the arms 1026*a*, 1026*b* such that lugs 1032*a*, 1032*b* are seated in corresponding guides 1028*a*, 1028*b*.

As particularly shown in FIG. 27, the door element 1014 includes an instructional feature 1044 in the form of an arrow, for example, that indicates the approximate direction in which force is be applied to translate the door 1014 along guides 1028*a*, 1028*b* to open the door. The force to open the door 1014 may be applied to the ledge 1046. The ledge 1046 may be in the form of a handle, formed integrally with the door element 1014. The ledge 1046 allows a force to be applied in the plane of the door element 1014 by a finger, or the leading end (i.e. the end to be inserted) of a connector, such as an electrical plug. When the door element 1014 is in the open position, as shown in FIG. 28, the ledge 1046 may rest in a recess 1048 in the insert 1020. By resting the ledge 1046 in recess 1048 the door element 1014 is able to lie flush with the plane defined by the front (i.e. in the direction from which an electrical plug may be inserted) surface of the insert 1020.

As particularly shown in FIGS. 29 to 35, the door element 1014 includes guides 1050*a*, 1050*b* with caming surfaces 1052*a*, 1052*b* that guide an electrical connector, such as an electrical plug, when the electrical connector is slideably inserted into the socket 1013 of the electrical connector 1000. The guides 1050*a*, 1050*b* also include curved guiding surfaces 1054*a*, 1054*b* to ease the entry of a mating plug into the socket 1013 of electrical connector 1000.

The door element 1014 further includes guiding lugs 1056*a*, 1056*b*, lying exposed when the door element 1014 is in the open position. These guiding lugs 1056*a*, 1056*b* act to guide a mating electrical connector during insertion. The guiding lugs 1056*a*, 1056*b* provide locking surfaces 1058*a*, 1058*b*. The locking surfaces 1058*a*, 1058*b* may engage with a locking clip 266 on the electrical plug 104 when the plug 104 is inserted in the electrical connector 1000. The locking surfaces 1058*a*, 1058*b* of guiding lugs 1056*a*, 1056*b* advantageously resist removal of the mating plug 104 from the electrical connector 1000 in the case when the locking clip 266 has not been actuated (i.e. squeezed towards the body of the electrical plug 104).

Figure 32:
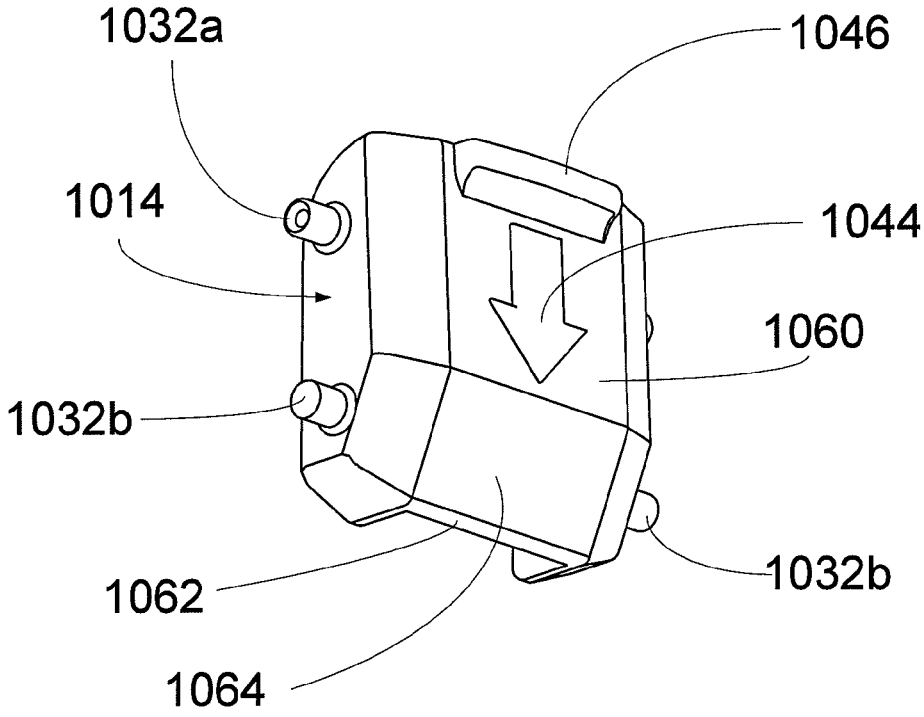
FIG. 32 is a diagrammatic illustration of a perspective view of the front of the door element shown in FIG. 29.
Figure 33:
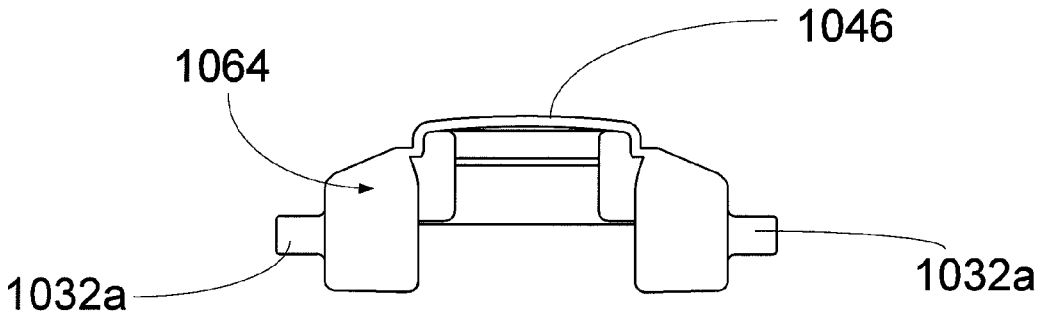
FIG. 33 is a diagrammatic illustration of top view of the door element shown in FIG. 29.
Figure 34:
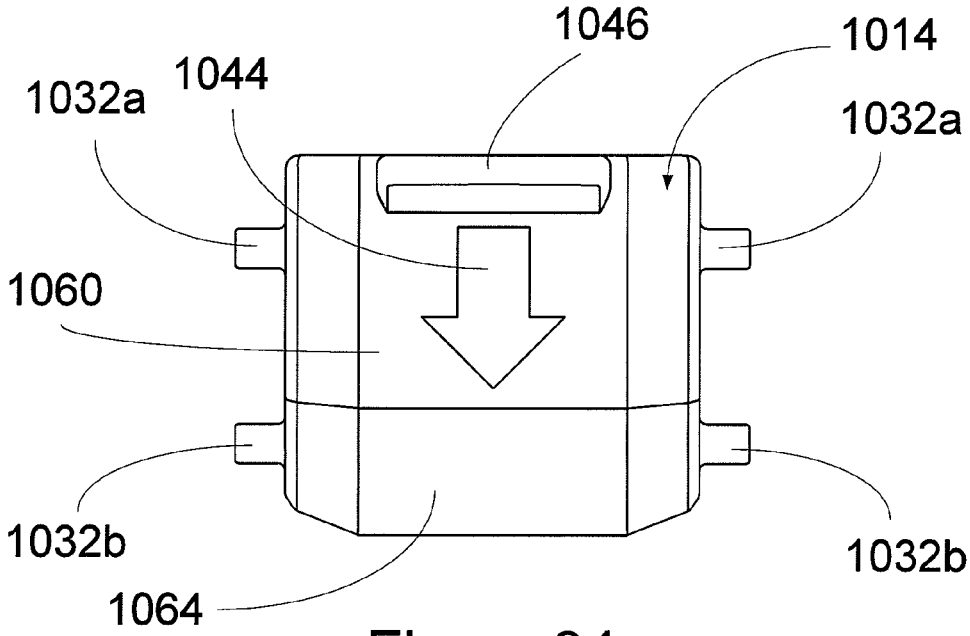
FIG. 34 is a diagrammatic illustration of a front view of the door element shown in FIG. 29.
Figure 35:
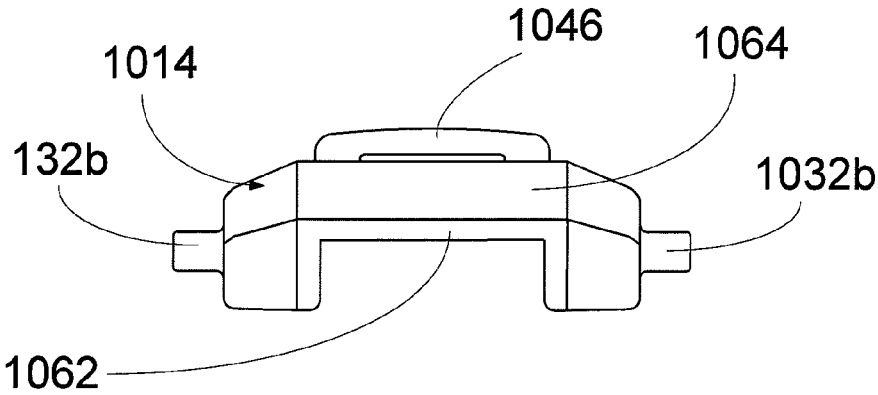
FIG. 35 is a diagrammatic illustration of a bottom view of the door element shown in FIG. 29.
Figure 36:
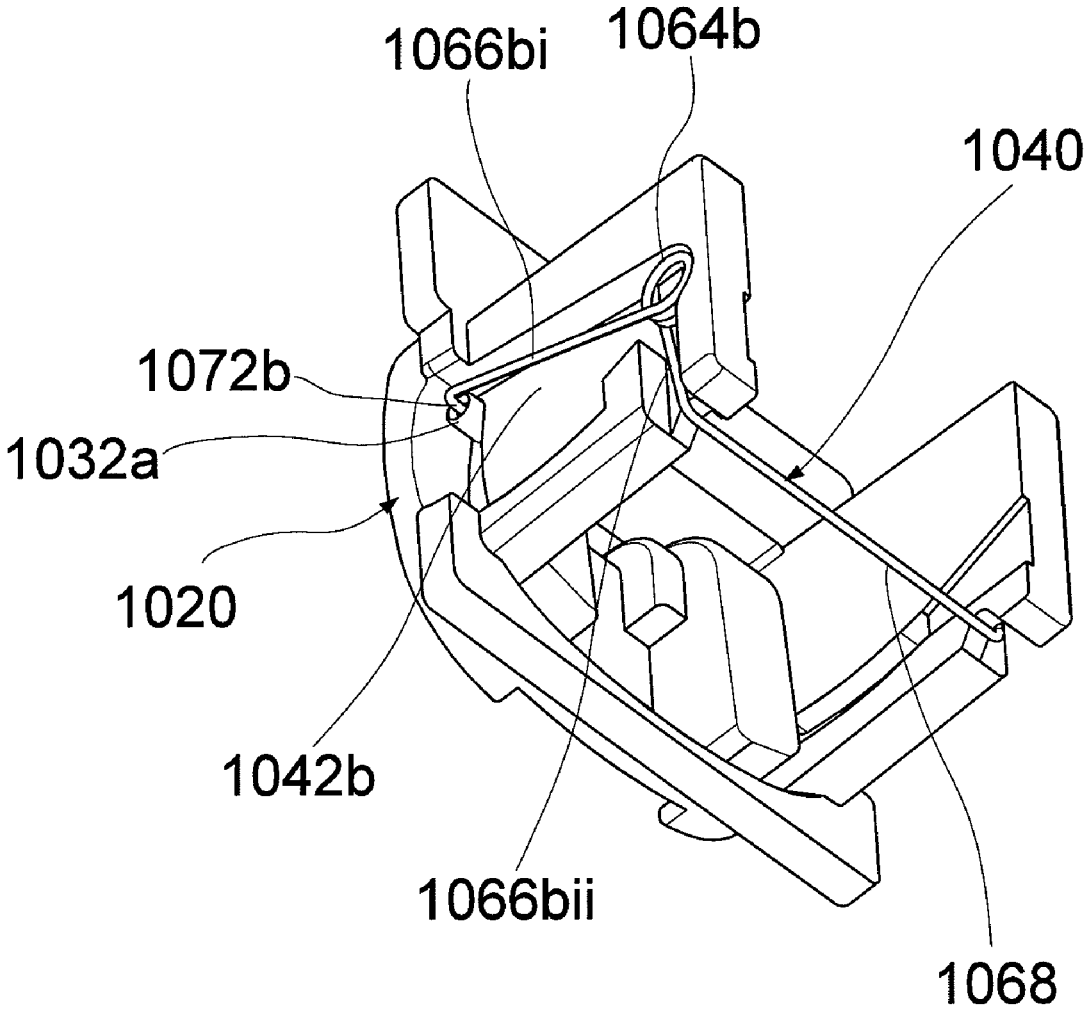
FIG. 36 is a diagrammatic illustration of a perspective view of the door element and the insert of the connector shown in FIG. 24.

As particularly shown in FIG. 32, a front face 1060 of the door element 1014 includes, a transverse edge 1062 that leads the door element 1014 when moved from the closed position towards the open position. A lower portion 1064 of the door 1014 is tapered inwards (i.e. into the socket 1013) from the front face 1060 to enable the door element 1014 to move without catching the floor of the insert 1020 as it moves between the closed position towards the open position.

The resilient biasing means 1040 resiliently holds the door 1014 in the default closed position covering the socket 1013. Thus, in its default operating position, the electrical connector 1000 inhibits ingress of contaminant materials that may short, degrade or clog the electrical contact elements, and prevents accidental access to the electrical contact elements.

As particularly shown in FIGS. 36 to 41, the resilient biasing means 1040 is includes two torsion springs 1062*a*, 1062*b* formed from a single length of wire that is seated in the biasing recesses 1042*a*, 1042*b*. Each torsion spring 1062*a*, 1062*b* includes a coil 1064*a*, 1064*b* having first and second arms 1066*ai*, 1066*aii*, 1066*bi*, 1066*bii* extending outwardly therefrom. The coils 1064*a*, 1064*b* are mounted on respective lugs 1070*a*, 1070*b* in the biasing recesses 1042*a*, 1042*b*. The second arms 1066*aii*, 1066*bii* extend downwardly from the coils 1064*a*, 1064*b* generally in direction "D" through channels 1067*a*, 1067*b* and are connected to a common transverse arm 1068 that extends between the arms 1026*a*, 1026*b* of the insert 1020. Movement of the second arms 1066*aii*, 1066*bii* is restricted by the channels 1067*a*, 1067*b*. The first arms 1066*ai*, 1066*bi* extend generally towards the socket 1013 and resiliently bear against upper sections of the recess 1042*a*, 1042*b*. Distal ends 1072*a*, 1072*b* of the first arms 1066*ai*, 1066*bi* are bent inwards so that they are seated in respective guides 1028*a* of the insert 1020. The first arms 1066*ai*, 1066*bi* thereby track along the guides 1028*a* when the first arms 1066*ai*, 1066*bi* are resiliently compressed so as to move towards the second arms 1066*aii*, 1066*bii*.

Figure 37:
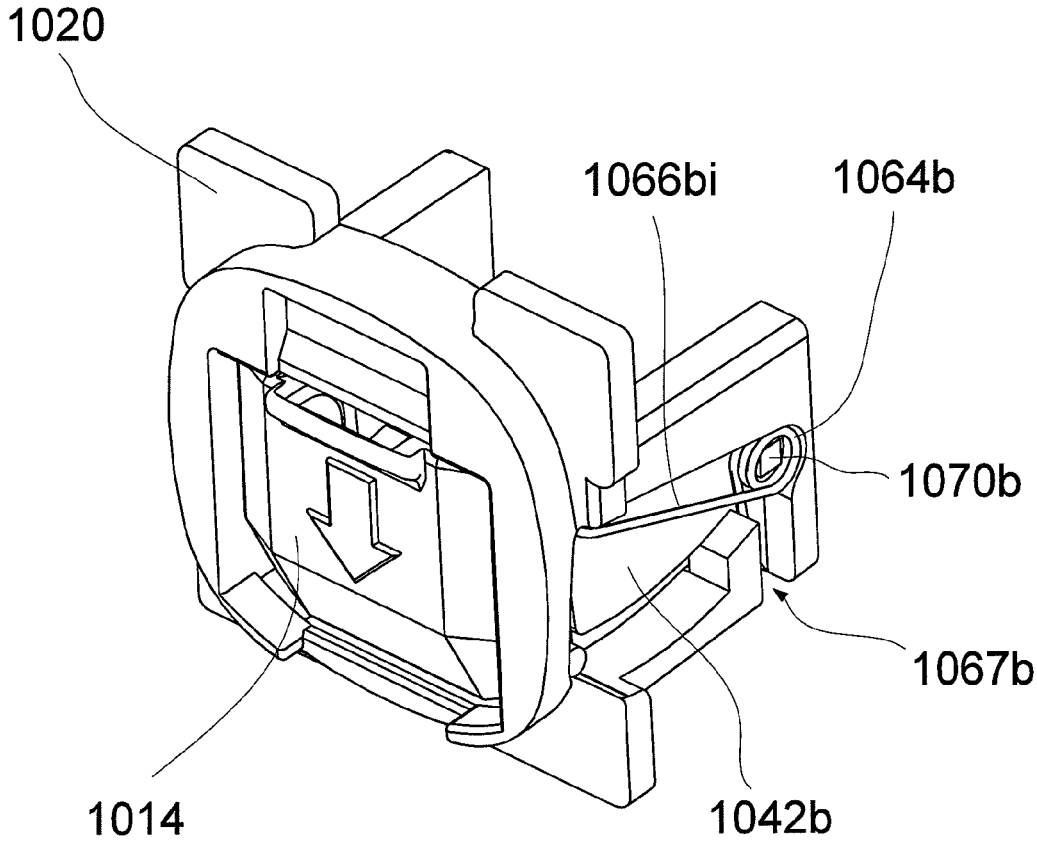
FIG. 37 is a diagrammatic illustration of another perspective view of the door element and the insert shown in FIG. 36.
Figure 38:
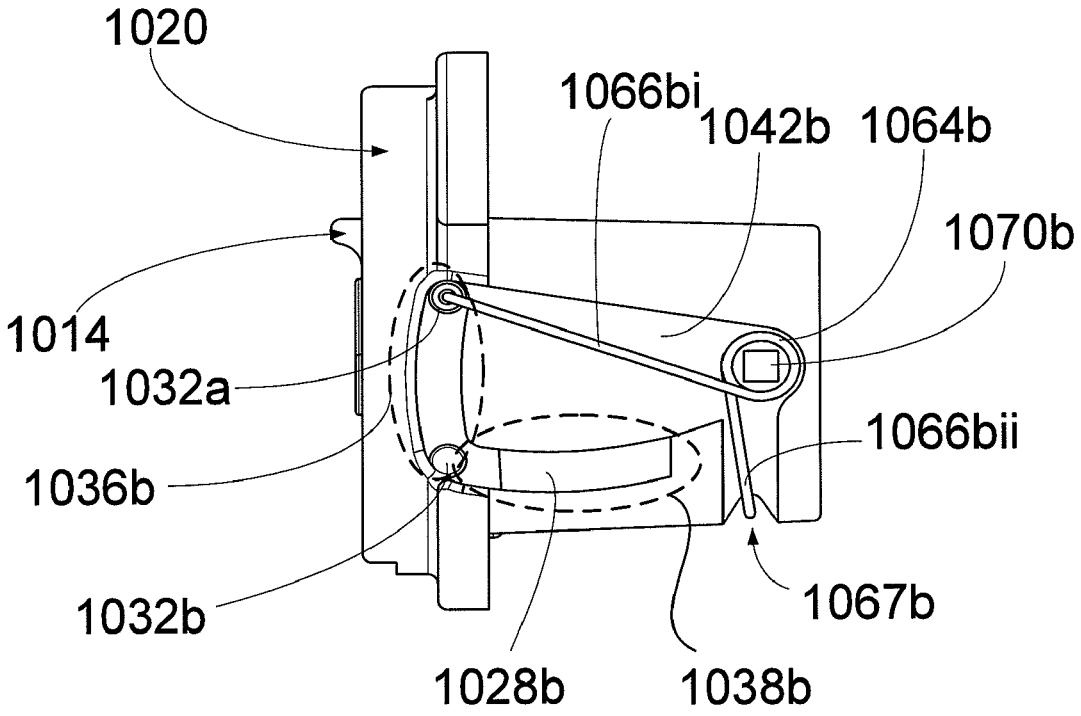
FIG. 38 is a diagrammatic illustration of a side view of the door element and the insert shown in FIG. 36.
Figure 39:
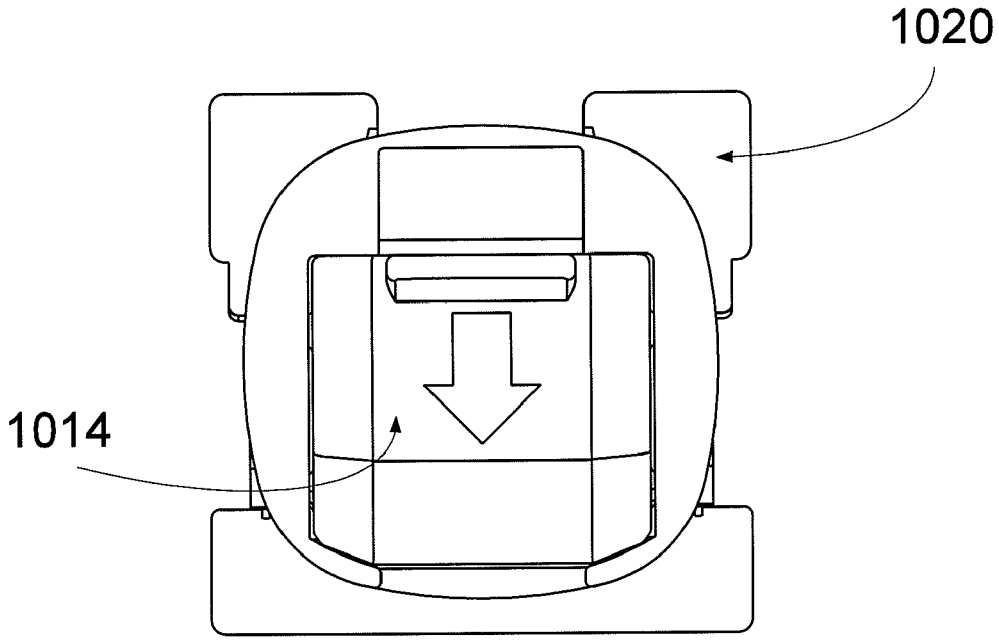
FIG. 39 is a diagrammatic illustration of a front view of the door element and the insert shown in FIG. 36.
Figure 40:
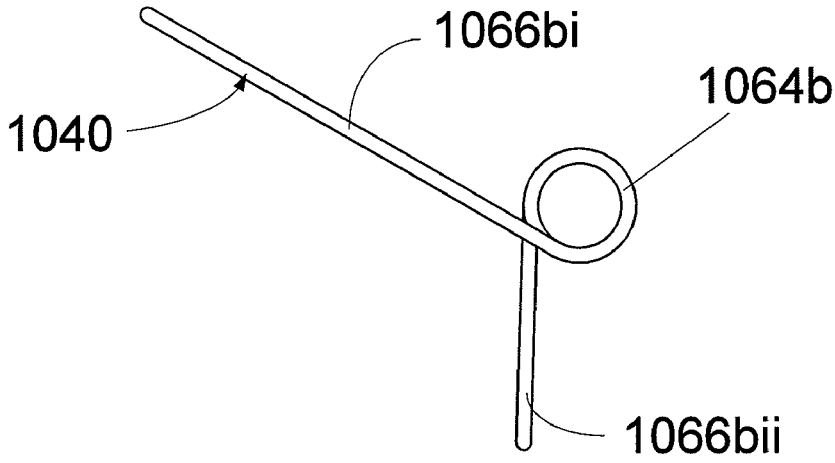
FIG. 40 is a diagrammatic illustration of a side view of a biasing means of the electrical connector shown in FIG. 24 arranged in a condition of use.
Figure 41:
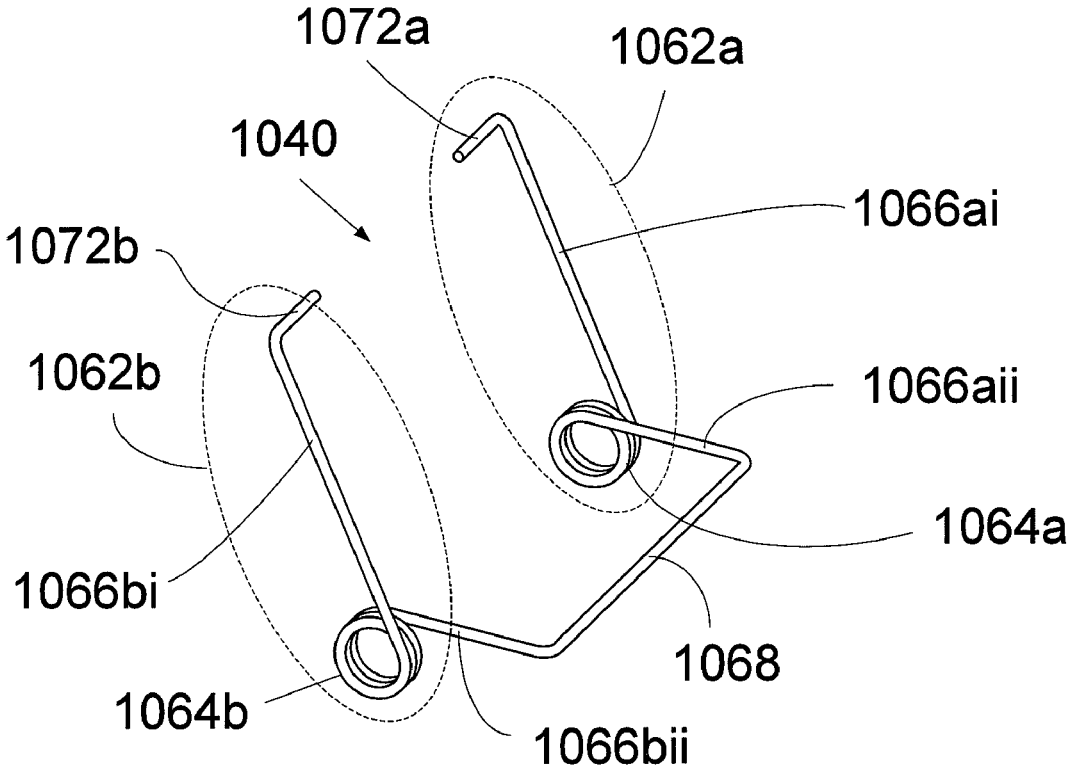
FIG. 41 is a diagrammatic illustration of a perspective view of the biasing means shown in FIG. 40 arranged in an another condition of use.

The leading lugs 1032*a* of the door element 1014 have open ends that are shaped to at least partially receive the distal ends 1072*a*, 1072*b* of the first arms 1066*ai*, 1066*bi* of the spring 1040. In the installed condition as shown in FIGS. 37 to 39, the distal ends of the first arms 1066*ai*, 1066*bi* of the spring 1040 are seated in open ends of corresponding leading lugs 1032*a* of the door 1014. As the door element 1014 is opened, the distal ends 1072*a*, 1072*b* of the first arms 1066*ai*, 1066*bi* move along the arcuate path defined by the first portions 1036*a*, 1036*b* of the guides 1028*a*, 1028*b* against the natural resilience of the biasing means 1040. The biasing means 1040 applies a closing force tending to return the distal ends 1072*a*, 1072*b* of the first arms 1066*ai*,1066*bi* to the position shown in FIG. 37, thereby tending to close the door element 1014.

The first portion 1036*a*, 1036*b* of each guide 1028*a*, 1028*b* is generally arcuate so as to follow the distal ends 1072*a*, 1072*b* of the first arms 1066*ai*, 1066*bi* as the door 1014 is opened and they rotate towards the second arms 1066*aii*, 1066*bii*. The torsion springs 1062*a*, 1062*b* are advantageously formed as a single length of wire, which facilitates non-complex manufacturing.

An advantage of the present invention is that the force applied by the resilient biasing means 234, when the door element 202 is lying substantially in the open position, has a substantial component of force in direction "D" (i.e. in the plane of the exposed aperture of the socket 1013), and only a very small component of force along the axis of an inserted electrical plug 104 (e.g. in the opposite direction of arrow 270 in FIG. 10D) i.e. direction "X". Thus, when an electrical mating plug is inserted into the electrical connector 200, the resilient biasing means 234 applies very little force to eject the electrical mating plug from inside the electrical connector, which may be advantageous when the locking clip 266 is damaged, absent or fails to engage with locking surfaces 249.

A two-stage opening motion is required to translate the door element 202, 1014 from its closed position to its open position, as shown in FIGS. 10A to 10D. As a result, a two-stage force must be applied to the door element 202, 1014 to allow access to the contact points of the conductors inside the electrical conductor 200, 1000. An advantage of requiring the two-stage motion is that a child or pet is less likely to open the door element 202, 1014 and gain access to the conductive elements 215 inside the connector 200, 1000 than with a door element that requires only a one-stage motion, for example, the application of a force directly into the electrical connector 200, 1000.

Another advantage of the two-stage opening motion is that the door element 202, 1014 firstly slides away from the face of the socket 206, 1013, thus exposing the contacts, and secondly slides into the mount 204, 1022, therefore staying within the cross-sectional area of the face of the connector 200, 1000. If the door element 202, 1014 slid only away from the socket 206, 1013 but not into the mount 204, 1022, the open connector 200, 1000 would take up more cross-sectional area than in the closed position, which may make the connector 200, 1000 more difficult to install in small spaces.

An advantage of the electrical connector 200, 1000 including the removable insert 212, 1020 which seats the door element 202, 1014, is that the door element 202, 1014 and insert 212, 1020 are generic and can be inserted into more than one type of electrical connector. Conversely, when no door is required in the finished part, an electrical connector can have an alternate removable insert inserted that does not include a door element 202, 1014. These advantages allow for mass production of generic parts, ease of assembly and reduced costs.

The internal dimensions of electrical connector 200, 1000, defined by the dimensions of door element 202, 1014 and mount 204, 1022, are preferably selected to provide a snug fit for an inserted electrical connector, for example an RJ45 electrical mating plug.

It is to be appreciated that the embodiments of the invention described above with reference to the accompanying drawings have been given by way of example only and that modification and additional components may be provided to enhance the performance of the apparatus.

Throughout this specification and the claims which follow, unless the context requires otherwise, the word 'comprise,' and variations such as 'comprises' and 'comprising,' will be understood to imply the inclusion of a stated integer or step, or group of stated integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The claims defining the invention are as follows:

1. An electrical connector including:

(a) a housing having a socket shaped to at least partially receive a mating plug;

(b) a plurality of electrically conductive contact elements at least partially extending into said socket for effecting electrical connection with corresponding electrically conductive contacts of the plug; and (c) a door element coupled to the housing, wherein the door element is mounted for slidable movement along a nonlinear path between an open position whereby the socket is laid open for engagement by the mating plug and a closed position whereby access to the socket is inhibited;

wherein the door element includes guiding lugs for guiding the mating plug into the socket during insertion, wherein the guiding lugs include locking surfaces for engaging with a locking clip on the mating plug when the mating plug is inserted in the socket.

2. The electrical connector as claimed in claim 1, wherein the door element includes a ledge to be used to effect translation of the door from the closed position to the open position.

3. The electrical connector as claimed in claim 1, wherein the door element includes an instructional feature indicating a direction to apply a force to move the door element from the closed position to the open position.

4. The electrical connector as claimed in claim 1, wherein an exterior side of the door element that first enters the socket is tapered.

5. The electrical connector as claimed in claim 1, wherein the housing includes a removable insert to which the door element is coupled.

6. The electrical connector as claimed in claim 1, wherein movement of the door element along the non-linear path from the closed position towards the open position is constrained and includes a component of movement in a direction transverse to an insertion direction of the plug into the socket and a component of movement in a direction aligned with the insertion direction.

7. The electrical connector as claimed in claim 6, wherein during a first part of the movement of the door element along the nonlinear path from the closed position towards the open position, movement of the door element in the direction transverse to the insertion direction is greater than movement of the door element in the direction aligned with the insertion direction.

8. The electrical connector as claimed in claim 7, wherein during a second part of the movement of the door element along the nonlinear path from the closed position towards the open position, movement of the door element in the direction transverse to the insertion direction is less than movement of the door element in the direction aligned with the insertion direction.

9. The electrical connector as claimed in claim 1, wherein the nonlinear path is defined by two parallel guides formed in the housing.

10. The electrical connector as claimed in claim 9, wherein the guides are slot-like and formed in opposed interior walls of the housing.

11. The electrical connector as claimed in claim 9, further comprising two pairs of tracking lugs extending from opposite sides of the door element, each pair of tracking lugs being at least partially seated in a corresponding one of the guides.

12. The electrical connector as claimed in claim 11, wherein the tracking lugs effect translation of the door element along the nonlinear path as the door element moves between the open position and the closed position.

13. The electrical connector as claimed in claim 9, wherein the guides include first sections generally parallel to an insertion direction of the socket and second sections normal to the insertion direction.

14. The electrical connector as claimed in claim 13, wherein the first sections of the guides are substantially parallel and at least partially arcuate, and the second sections of the guides are substantially parallel and at least partially arcuate.

15. The electrical connector as claimed in claim 1, further including a resilient biasing means that applies a force tending to maintain the door element in the closed position.

16. The electrical connector claimed in claim 15, wherein the resilient biasing means includes a torsion spring having a first leg substantially retained in the housing and a second leg substantially retained in the door element.

17. The electrical connector as claimed in claim 16, wherein the torsion spring is one of two torsion springs, each having a first leg substantially retained in the housing and a second leg substantially retained in the door element, the springs being interconnected by a bridge portion.

18. The electrical connector as claimed in claim 17, wherein the two torsion springs are formed as a single length of wire.

19. The electrical connector as claimed in claim 1, wherein the door element is seated on a floor of the socket when arranged in the open position.

20. The electrical connector as claimed in claim 19, wherein the door element is seated generally flat on the floor of the socket when arranged in the open position.

21. A door element for an electrical connector, including:

(a) a body defining a generally planar exterior surface for inhibiting access to a socket of the electrical connector;

(b) two pairs of tracking lugs extending from opposite sides of the body for at least partially extending into corresponding guides of the electrical connector; and (c) guiding lugs arranged on an interior surface of the body, wherein the tracking lugs facilitate translation of the door element to open the socket to receive a mating connector plug or to close the socket to inhibit access to the socket by said plug, wherein the guiding lugs are configured to guide the mating plug into the socket during insertion, wherein the guiding lugs include locking surfaces for engaging with a locking clip on the mating plug when the mating plug is inserted.

22. The door element as claimed in claim 21, wherein an exterior side of the door element that first enters the socket is tapered.

23. The door element as claimed in claim 21, wherein the tracking lugs effect translation of the door element along a nonlinear path of the guides as the door element moves between an open position and a closed position.

24. The door element as claimed in claim 23, further comprising a ledge to be used to effect translation of the door element from the closed position to the open position.

25. The door element claimed in claim 23, wherein the door element is seated generally flat on a floor of the socket when arranged in the open position.

26. The door element as claimed in claim 23, wherein the door element includes an instructional feature indicating a direction to apply a force to move the door element from the closed position to the open position.

27. An electrical connector including:

(a) a housing defining a socket configured to at least partially receive a mating plug;

(b) a plurality of electrically conductive contact elements at least partially extending into the socket for effecting electrical connection with corresponding electrically conductive contacts of the mating plug;

(c) a door element coupled to the housing, the door element being moveable relative to the housing along a nonlinear path between an open position and a closed position, wherein the socket is laid open for engagement with the mating plug when the door element is in the open position and wherein access to the socket is inhibited when the door element is in the closed position; and (d) a torsion spring that applies a force biasing the door element to the closed position, the torsion spring having a first leg substantially retained in the housing and a second leg substantially retained in the door element.

28. The electrical connector as claimed in claim 27, wherein the torsion spring is one of two torsion springs, each having a first leg substantially retained in the housing and a second leg substantially retained in the door element, the springs being interconnected by a bridge portion.

29. The electrical connector as claimed in claim 28, wherein the two torsion springs are formed as a single length of wire.

* * * * *